US009340045B2

(12) United States Patent
Terada et al.

(10) Patent No.: US 9,340,045 B2
(45) Date of Patent: May 17, 2016

(54) RECORDING APPARATUS

(71) Applicant: Brother Kogyo Kabushiki Kaisha, Nagoya-shi, Aichi-ken (JP)

(72) Inventors: Kohei Terada, Kiyosu (JP); Shinya Yamamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/580,563

(22) Filed: Dec. 23, 2014

(65) Prior Publication Data

US 2015/0183243 A1 Jul. 2, 2015

(30) Foreign Application Priority Data

Dec. 27, 2013 (JP) ..... 2013-271987

(51) Int. Cl.

| | |
|---|---|
| ***B41J 29/38*** | (2006.01) |
| ***B41J 2/015*** | (2006.01) |
| ***B41J 29/393*** | (2006.01) |
| ***B41J 13/00*** | (2006.01) |
| ***B41J 3/54*** | (2006.01) |
| ***B41J 3/60*** | (2006.01) |

(52) U.S. Cl.

CPC ..... *B41J 13/0009* (2013.01); *B41J 3/543* (2013.01); *B41J 3/60* (2013.01)

(58) Field of Classification Search

CPC ..... B41J 2/162

USPC ..... 347/16, 19–20, 9

See application file for complete search history.

(56) References Cited

U.S. PATENT DOCUMENTS

| | | | | |
|---|---|---|---|---|
| 5,940,186 | A | 8/1999 | Barry et al. | |
| 7,188,929 | B2 * | 3/2007 | Lofthus | 347/40 |
| 7,315,709 | B2 | 1/2008 | Kim et al. | |
| 2010/0315460 | A1 | 12/2010 | Matsuhashi | |
| 2013/0201269 | A1 * | 8/2013 | Hozumi | 347/187 |

FOREIGN PATENT DOCUMENTS

| | | |
|---|---|---|
| JP | 2011-020438 | 2/2011 |

* cited by examiner

*Primary Examiner* — Jason Uhlenhake

(74) *Attorney, Agent, or Firm* — Frommer Lawrence & Haug LLP

(57) ABSTRACT

A recording apparatus includes: recording modules; a storage; a receiver; a first path extending from the storage to the plurality of recording modules; 6a second path extending from the recording modules to the receiver; and third paths extending between the first path and the second path via first connection positions and second connection positions. The second path has one end connected to the receiver and the other end connected to a portion of the first path which is located upstream of the first connection positions. When the recording medium having passed through the first path once is conveyed to the first path again via the second path, the conveyor conveys the recording medium in a state in which a first surface and a second surface of the recording medium are reversed when compared with a stain which the recording medium passes through the first path in preceding conveyance.

13 Claims, 15 Drawing Sheets

RECORDING APPARATUS

CROSS REFERENCE TO RELATED APPLICATION

The present application claims priority from Japanese Patent Application No. 2013-271987, which was filed on Dec. 27, 2013, the disclosure of which is herein incorporated by reference in its entirety.

BACKGROUND

1. Technical Field

The present invention relates to a recording apparatus including a plurality of recording modules.

2. Description of the Related Art

There is conventionally known a recording apparatus including a plurality of recording modules and configured to use the plurality of recording modules to perform image recording on a recording medium having a first surface and a second surface that is a back side of from the first surface. There is known a recording apparatus (a printer) including: three recording modules (recording units) arranged in a vertical direction; a sheet storage (an automatic sheet-supply device); a sheet receiver (an output tray); a sheet-supply path extending from the automatic sheet-supply device to each of the recording units; three conveyance paths to which a recording sheet printed in each of the recording units is conveyed; and a flip path portion. The flip path portion flips the recording sheet printed in each of the recording units and conveys the flipped recording sheet to each of the recording units again. The flip path portion connects between the output tray and a position located downstream of a joining position at which the three conveyance paths merge with each other. The flip path portion is connected to a portion of the sheet-supply path which is located upstream of a branch position. After recording on a first surface of the recording sheet by one of the recording units and before recording on a second surface of the recording sheet, the recording sheet is conveyed from any one of the three conveyance paths to the flip path portion, then flipped by the flip path portion, and conveyed into the sheet-supply path again.

SUMMARY

The above-described printer has difficulty in reducing the size of the flip path portion due to the construction of the paths, making it impossible to reduce the size of the apparatus.

This invention has been developed to provide a recording apparatus with reduced size.

The present invention provides a recording apparatus including: a plurality of recording modules arranged in one direction and each including a recording device configured to perform recording on a recording medium having a first surface and a second surface which is a back side from the first surface; a storage configured to accommodate the recording medium; a receiver configured to receive the recording medium on which recording is performed by any one of the plurality of recording modules; a first path whose one end is connected to the storage, the first path being defined such that the recording medium is conveyed toward a corresponding one of the plurality of recording modules; a second path having two ends, one of which is connected to the receiver, the second path being defined such that the recording medium conveyed from a corresponding one of the plurality of recording modules; a plurality of third paths extending respectively via the plurality of recording modules and defined such that the recording medium to be conveyed in the first path is conveyed toward a corresponding one of the plurality of third paths via a corresponding at least one of a plurality of first connection positions positioned on the first path and corresponding respectively to the plurality of recording modules, the plurality of third paths being defined such that the recording medium to be conveyed in the corresponding one of the plurality of third paths is conveyed toward the second path via a corresponding at least one of a plurality of second connection positions positioned on the second path and corresponding respectively to the plurality of recording modules; and a conveyor configured to convey the recording medium along the first path, the second path, and the plurality of third paths. The two ends of the second path include another end located on an opposite side of the plurality of second connection positions from the one end of the second path, said another end being connected to a portion of the first path which is located upstream of the plurality of first connection positions. The conveyor is configured to when the recording medium having passed through the first path once is conveyed to the first path again via the second path, convey the recording medium in a state in which the first surface and the second surface are reversed when compared with a state in which the recording medium passes through the first path in preceding conveyance.

The present invention also provides a recording apparatus including: a plurality of recording modules arranged in one direction and each including a recording device configured to perform recording on a recording medium having a first surface and a second surface which is a back side from the first surface; a storage configured to accommodate the recording medium a receiver configured to receive the recording medium on which recording is performed by any one of the plurality of recording modules; a first path whose one end is connected to the storage, a plurality of first connection positions being positioned on the first path and respectively corresponding to the plurality of recording modules; a second path whose one end is connected to the receiver, a plurality of second connection positions being positioned on the second path and respectively corresponding to the plurality of recording modules; a plurality of third paths extending respectively via the plurality of recording modules and each having: one end connected to a corresponding one of the plurality of first connection positions; and another end connected to a corresponding one of the plurality of second connection positions; and a conveyor configured to convey the recording medium along the first path, the second path, and the plurality of third paths. The second path has another end located on opposite side of the plurality of second connection positions from the one end of the second path. The another end is connected to a portion of the first path which is located upstream of the plurality of first connection positions. The second path is defined such that the recording medium conveyed through the second path is conveyed to the first path in a state in which the first surface and the second surface are reversed when compared with preceding conveyance of the recording medium through the first path.

BRIEF DESCRIPTION OF THE DRAWINGS

The objects, features, advantages, and technical and industrial significance of the present invention will be better understood by reading the following detailed description of the embodiments of the invention, when considered in connection with the accompanying drawings, in which.

DETAILED DESCRIPTION OF THE EMBODIMENTS

Figure 1:
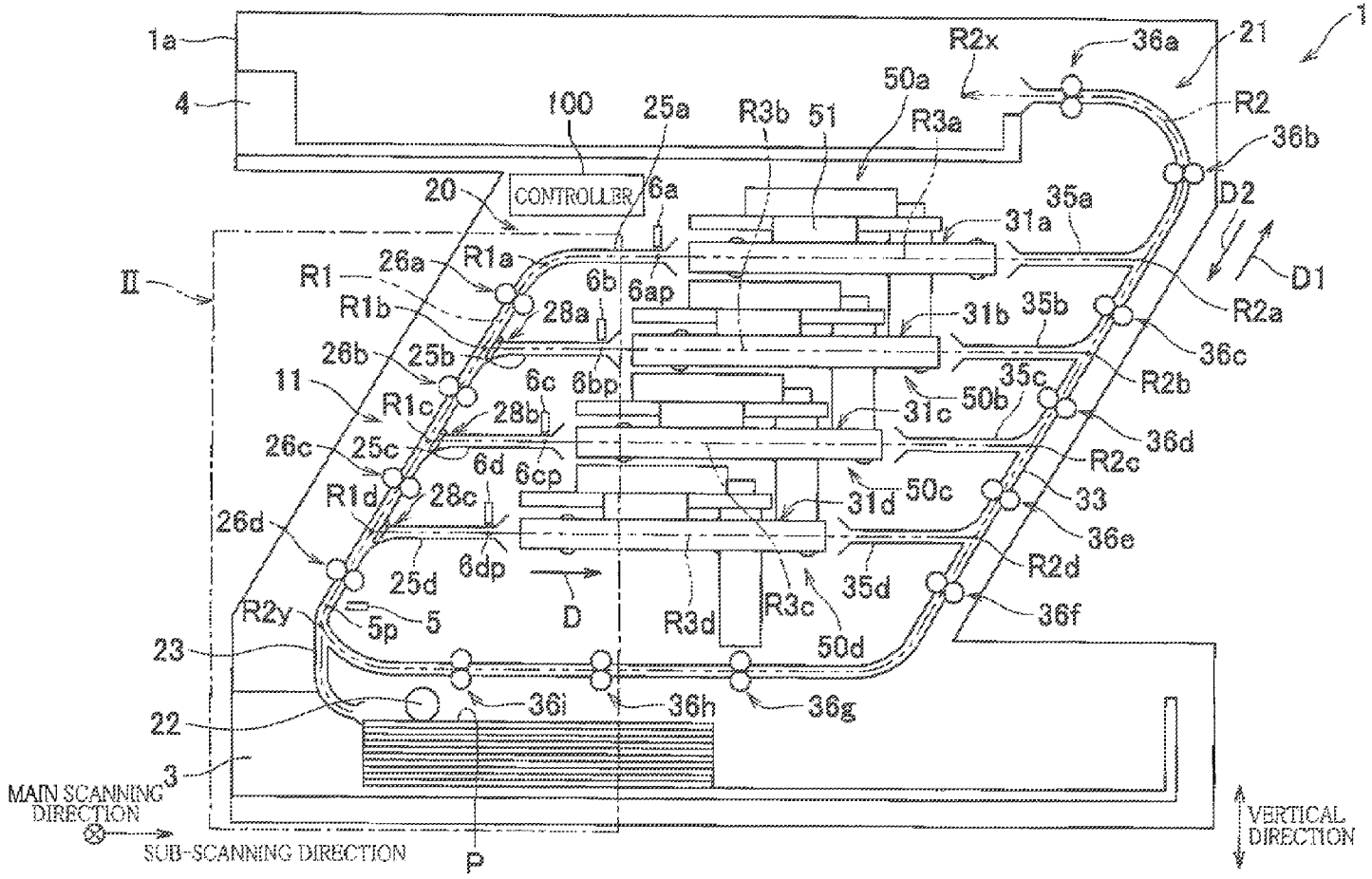
FIG. 1 is a schematic side view illustrating an internal structure of an ink-jet printer according to a first embodiment of the present invention.

Hereinafter, there will be described embodiments of the present invention by reference to the drawings.

First, there will be explained an overall configuration of an ink-jet printer 1 according to a first embodiment of the present invention with reference to FIG. 1.

The printer 1 includes a housing 1*a* having a Z-shape in cross section. Devices and components arranged in the housing 1*a* include recording modules 50*a*-50*d*, a conveying unit 20 as one example of a conveyor, a sheet storage 3, a sheet receiver 4, and a controller 100.

The recording modules 50*a*-50*d* are arranged in the vertical direction. A recording module 50*a* is the farthest from the sheet storage 3 and the nearest to the sheet receiver 4 among the recording modules 50*a*-50*d*. The recording module 50*d* is the nearest to the sheet storage 3 and the farthest from the sheet receiver 4 among the recording modules 50*a*-50*d*.

The recording modules 50*a*-50*d* have the same construction and each includes a head 51 as one example of a recording device. Four cartridges, not shown, are mountable on and removable from the housing 1*a*. Each of the cartridges stores black ink and is connected to a corresponding one of the heads 51 by a tube and a pump. The controller 100 drives the pump to supply the ink from the cartridge to the head 51 through the tube. The head 51 is capable of performing image recording on a front surface and a back surface of a sheet P. The front strike of the sheet P is a surface facing downward in the sheet storage 3 and is one example of a first surface of a recording medium. The back surface of the sheet P is a surface facing upward in the sheet storage 3 and is one example of a second surface of the recording medium.

The conveying unit 20 is configured to convey a sheet P as one example of the recording medium along any one of a first path R1, a second path R2, and four third paths R3*a*-R3*d*. The conveying unit 20 includes a first conveying portion 11, a second conveying portion 21, and four third conveying portions 31*a*-31*d*. The first conveying portion 11 is configured to convey the sheet P along the first path R1. The second conveying portion 21 is configured to convey the sheet P along the second path R2 in a first direction D1 or a second direction D2. The first direction D1 is directed toward the sheet receiver 4, and the second direction D2 is a direction opposite the first direction D1. Each of the third conveying portions 31*a*-31*d* is configured to convey the sheet P along a corresponding one of the third paths R3*a*-R3*d*.

One end of the first path R1 is connected to the sheet storage 3, and the first path R1 extends obliquely upward from the one end. Four first connection positions R1*a*-R1*d* are defined on the first path R1 so as to correspond to the respective recording modules 50*a*-50*d*. The first connection position R1*a* corresponds to the other end of the first path R1.

The second path R2 has one end R2*x* connected to the sheet receiver 4. The second path R2 extends obliquely downward from the one end R2*x*, then extends generally horizontally between the four recording modules 50*a*-50*d* and the sheet storage 3, and is finally connected to the first path R1. Four second connection positions R2*a*-R2*d* are defined on the second path R2 so as to correspond to the respective recording modules 50*a*-50*d*. The second path R2 has the other end R2*y* located such that the four second connection positions R2*a*-R2*d* are interposed between the one end R2*x* and the other end R2*y*. The other end R2*y* is located upstream of the four first connection positions R1*a*-R1*d* located on the post path R1.

The third paths R3*a*-R3*d* extend through the respective recording modules 50*a*-50*d*. Each of the third paths R3*a*-R3*d* has (i) one end connected to a corresponding one of the first connection positions R1*a*-R1*d* and (ii) the other end connected to a corresponding one of the second connection positions R2*a*-R2*d*, and each of the third paths R3*a*-R3*d* extends horizontally.

The first conveying portion 11 includes a sheet-supply roller 22, roller pairs 26*a*-26*d*, and a guide 23. The second conveying portion 21 includes roller pairs 36*a*-36*i* and a guide 33. Each of the third conveying portions 31*a*-31*d* includes: a corresponding one of guides 25*a*-25*d* provided on upstream portions of the respective third paths R3*a*-R3*d*; a corresponding one of individual conveyors 53 (see FIGS. 3-5) provided on central portions of the respective third paths R3*a*-R3*d*; and a corresponding one of guides 35*a*-35*d* provided on downstream portions of the respective third paths R3*a*-R3*d*.

The sheet-supply roller 22 is disposed so 65 to contact an uppermost one of the sheets P stored in the sheet storage 3. The controller 100 drives a sheet-supply motor 22M (see FIG. 6) to rotate the sheet-supply roller 22. This rotation supplies the uppermost sheet P from the sheet storage 3.

Each of the roller pairs 26*a*-26*d*, 36*a*-36*i* has two rollers contacting each other and conveys the sheet P, with the two rollers nipping the sheet P therebetween. One of the two rollers of each of the roller pairs 26*a*-26*d* is a drive roller which is rotated by an upstream conveying motor 26M (see FIG. 6) driven by the controller 100. One of the two rollers of each of the roller pairs 36*a*-36*i* is a drive roller which is rotated by a downstream conveying motor 36M (see FIG. 6) driven by the controller 100. The other of the two rollers of each of the roller pairs 26*a*-26*d*, 36*a*-36*i* is a driven roller which is rotated, in a direction reverse to a direction of the rotation of the drive roller, by the rotation of the drive roller while contacting the drive roller. The roller pairs 26*a*-26*d* are driven in synchronization with each other by the upstream conveying motor 26M. The roller pairs 36*a*-36*i* are driven in synchronization with each other by the downstream conveying motor 36M. Each of the roller pairs 36*a*-36*i* is rotatable forwardly and reversely, that is, each of the roller pairs 36*a*-36*i* is rotatable in a forward direction in which the sheet P is conveyed in the first direction D1 and in a reverse direction in which the sheet P is conveyed in the second direction D2.

Each of the guides 23, 33, 25*a*-25*d*, 35*a*-35*d* includes a pair of plates disposed spaced apart from each other. The guide 23 defines the first path R1. The guide 33 defines the second path R2. Each of guides 25*a*-25*d* defines an upstream portions of a corresponding one of the third paths R3*a*-R3*d* and is connected to the guide 23 at a corresponding one of the first connection positions R1*a*-R1*d*. Each of the guides 35*a*-35*d* defines a downstream portion of a corresponding one of the third paths R3*a*-R3*d* and is connected to the guide 33 at a corresponding one of the second connection positions R2*a*-R2*d*. Each of the guides 25*a*-25*d*, 35*a*-35*d* extends horizontally.

Switchers 28*a*-28*c* are provided on the respective first connection positions R1*b*-R3*d*. Each of the switchers 28*a*-28*c* switches a destination of the sheet P conveyed to the first path R1, to any one of the third paths R3*a*-R3*d*. The switcher 28*a* at the first connection position R1*b* switches the destination of the sheet P to any one of the third path R3*a* and the third path R3*b*. The switcher 28*b* at the first connection position R1*c* switches the destination of the sheet P to any one of the third path R3*c* and one of the third paths R3*a*, R1*b*. The switcher 28*c* at the first connection position R1*d* switches the destination of the sheet P to any one of the third path R3*d* and one of the third paths R1*a*-R1*c*.

Figure 2:
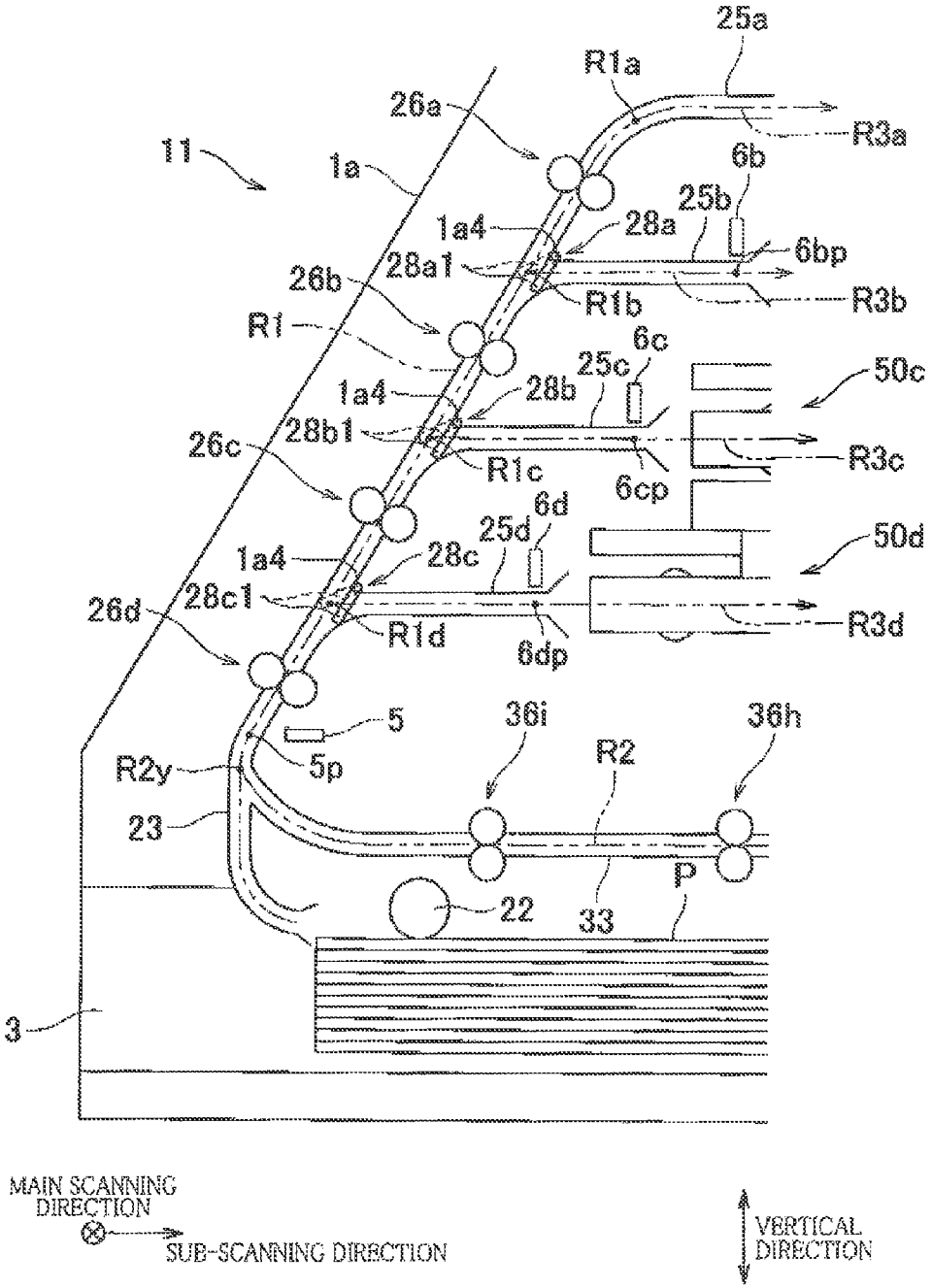
FIG. 2 is an enlarged view of the area II illustrated in FIG. 1.
Figure 6:
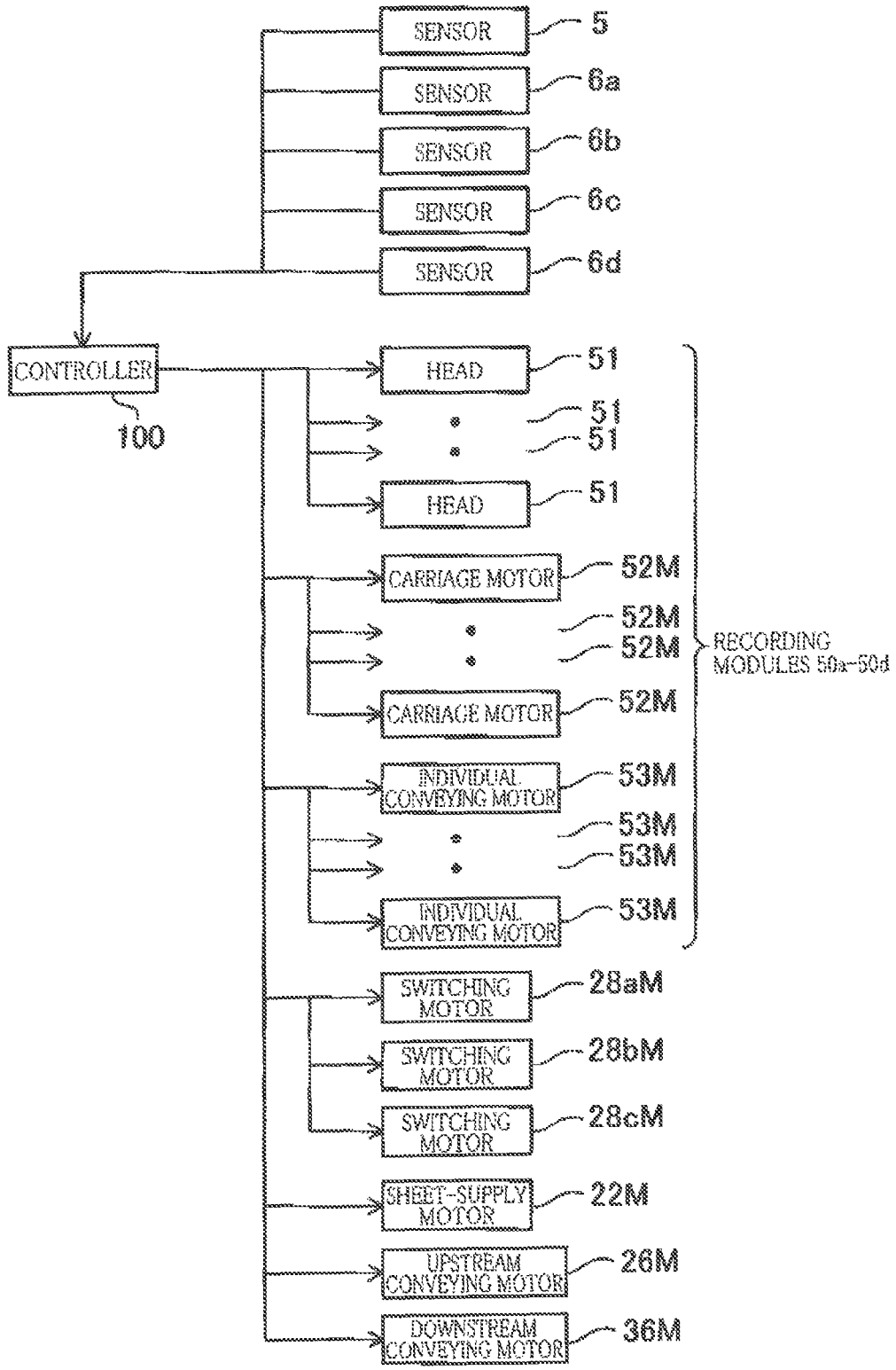
FIG. 6 is a block diagram illustrating an electric configuration of the printer illustrated in FIG. 1.

The switchers 28*a*-28*c* respectively include pivot members 28*a*1-28*c*1 (see FIG. 2) and switching motors 28*a*M-28*c*M (see FIG. 6). Each of the pivot members 28*a*1-28*c*1 is pivotable about a corresponding one of pins 1*a*4 provided in the housing 1*a*. The controller 100 drives each of the switching motors 28*a*M-28*c*M to switch a position of a corresponding one of the pivot members 28*a*1-28*c*1 between a first position indicated by solid lines in FIG. 2 and a second position indicated by broken lines in FIG. 2. At the first position, a distal end of each of the pivot members 28*a*1 -28*c*1 is held in contact with the corresponding one of the guide 25*b*, 25*c*, 25*d*. At the second position, the distal end of each of the pivot members 28*a*1-28*c*1 is held in contact with the guide 23.

When the pivot member 28*a*1 is located at the first position, the first path R1 is opened, and the third path R1*b* is closed at the first connection position R1*b*. Accordingly, the sheet P conveyed to the first connection position R1*b* along the first path R1 is further conveyed upward along the first path R1 and conveyed to the recording module 50*a*, along the third path R3*a* via the first connection position R1*a*. When the pivot member 28*a*1 is located at the second position, the first path R1 is closed, and the third path R3*b* is opened at the first connection position R1*b*. Accordingly, the sheet P conveyed to the first connection position R1*b* along the first path R1 is conveyed to the recording module 50*b* along the third path R3*b*.

When the pivot member 28*b*1 is located at the first position, the first path R1 is opened, and the third path R3*c* is closed at the first connection position R1*c*. Accordingly, the sheet P conveyed to the first connection position R1*c* along the first path R1 is further conveyed to the first connection position R1*b* along the first path R1. When the pivot member 28*b*1 is located at the second position, the first path R1 is closed, and the third path R3*c* is opened at the first connection position R1*c*. Accordingly, the sheet P conveyed to the first connection position R1*c* along the first path R1 is conveyed to the recording module 50*c* along the third path R1*c*.

When the pivot member 28*c*1 is located at the first position, the first path is opened, and the third path R3*d* is closed at the first connection position R1*d*, Accordingly; the sheet P conveyed to the first connection position R1*d* along the first path R1 is further conveyed to the first connection position R1*c* along the first path R1. When the pivot member 28*c*1 is located at the second position, the first path R1 is closed, and the third path R3*d* is opened at the first connection position R1*d*, Accordingly, the sheet P conveyed to the first connection position R1*d* along the first path R1 is conveyed to the recording module 50*d* along the third path R3*d*.

A sensor 5 is disposed between the sheet-supply roller 22 and the roller pair 26*d* at a position opposite the first path R1. Sensors 6*a*-6*d* are disposed on the respective third paths R3*a*-R3*d* at positions located upstream of the respective recording modules 50*a*-50*d*.

Each of the sensors 5, 6*a*-6*d* is configured to output a signal indicating the presence or absence of the sheet P at a corresponding one of sensing positions 5*p*, 6*ap*-6*dp*. Each of the sensors 5, 6*a*-6*d* outputs an ON signal when there is a sheet P at the corresponding position, and outputs an OFF signal when there is no sheet P at the corresponding position. The sensing position 5*p* is located on the first path R1 at a position located upstream of the four first connection positions R1*a*-R1*d* and downstream of the other end R2*y*. The sensing positions 6*ap*-6*dp* are located on the respective third paths R3*a*-R3*d*.

Each of the sensors 5, 6*a*-6*d* includes an ON counter and an OFF counter. When an ON signal is output, the ON counter produces a counter pulse which is proportional to an amount of rotation of the upstream conveying motor 26M and starts counting the number of pulses, and when another ON signal is thereafter output, the ON counter resets the count. When an OFF signal is output, the OFF counter produces a counter pulse which is proportional to an amount of rotation of the upstream conveying motor 26M and starts counting the number of pulses, and when another OFF signal is thereafter output, the OFF counter resets the count. Count data created by the ON counter represents an amount of conveyance of the sheet P from the timing when the leading edge of the sheet P has reached a sensing position of a corresponding one of the sensors 5, 6*a*-6*d*. Count data created by the OFF counter represents an amount of conveyance of the sheet P from the timing when the trailing edge of the sheet P has reached the sensing position of the co responding one of the sensors 5, 6*a*-6*d*.

In the present embodiment the recording module 50*a* is one example of a first recording module, and each of the recording modules 50*b*-50*d* is one example of a second recording module. That is, the recording module 50*a* corresponds to the second connection position R2*a* that is located on the second path R2 at the most downstream position in the first direction D1 among the second connection positions R2*a*-R2*d*. Each of the sensors 6*a*-6*d* is one example of a first sensor, and the sensor 5 is one example of a fourth sensor. Each of the roller pairs 36*c*-36*e* is one example of a first roller pair, and the roller pair 36*b* is one example of a second roller pair. That is, the roller pan 36*c* is disposed between the second connection positions R2*a*, R2*b* adjacent to each other on the second path R2, the roller pair 36*d* is disposed between the second connection positions R2*b*, R2*c* adjacent to each other on the second path R2, and the roller pair 36*e* is disposed between the second connection positions R2*c*, R2*d* adjacent to each other on the second path R2. The roller pair 36*b* is disposed on the second path R2 at a position adjacent to the second connection position R2*a* in the first direction D1.

Each of the sheet storage 3 and the sheet receiver 4 is mountable on and removable from the housing 1*a* in a sub-scanning direction. The sheet storage 3 is a tray opening upward and can store a plurality of sheets P. The sheet receiver 4 is a tray opening upward and can receive or support a plurality of sheets P. Each of the sheet storage 3 and the sheet receiver 4 can store or receive the sheets P of various sizes including the postcard size, the A6 size, the A4 size, the letter size, and the A3 size.

The sub-scanning direction is parallel with the horizontal plane and parallel with the third paths R3*a*-R3*d*. A main scanning direction is a direction parallel with the horizontal plane and perpendicular to the sub-scanning direction. The vertical direction is perpendicular to the sub-scanning direction and the main scanning direction.

The controller 100 includes a central processing unit (CPU) as a computing device, a read only memory (ROM), a random access memory (RAM) including a non-transitory RAM, an application specific integrated circuit (ASIC), an interface (I/F), and an input/output port (I/O). The ROM stores programs to be executed by the CPU, various kinds of fixed data, and other similar data. The RAM temporarily stores data necessary for execution of the programs, such as image data, count data of various counters, and various control flags. The ASIC executes rewriting and sorting of image data and other processings such as a signal processing and an image processing. The interface transmits and receives data to and from an external device such as a PC connected to the printer 1. The input/output port inputs and outputs signals produced by various sensors.

Figure 3:
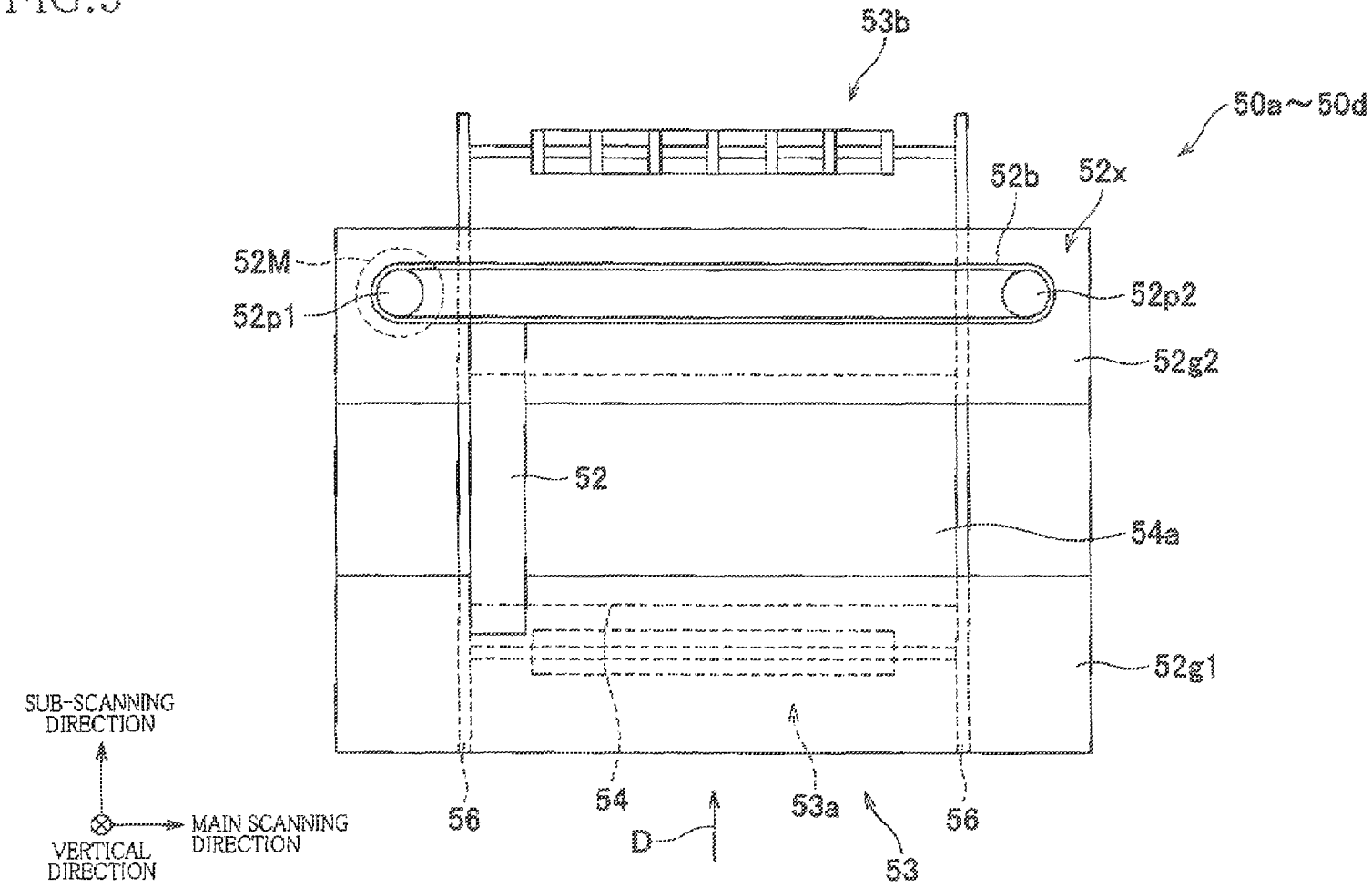
FIG. 3 is a plan view of a recording module of the printer illustrated in FIG. 1.
Figure 4:
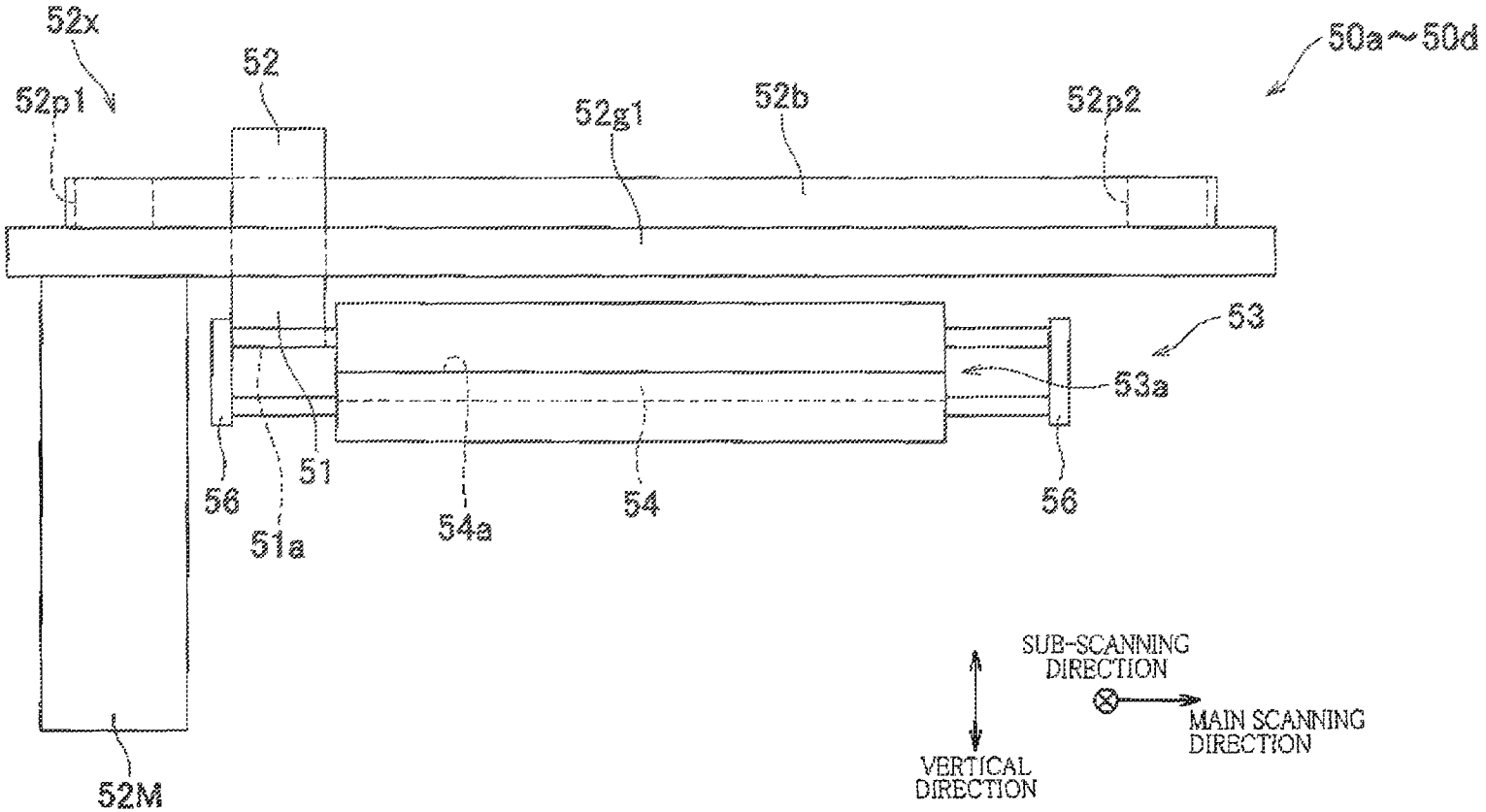
FIG. 4 is a front elevational view of the recording module of the printer illustrated in FIG. 1.
Figure 5:
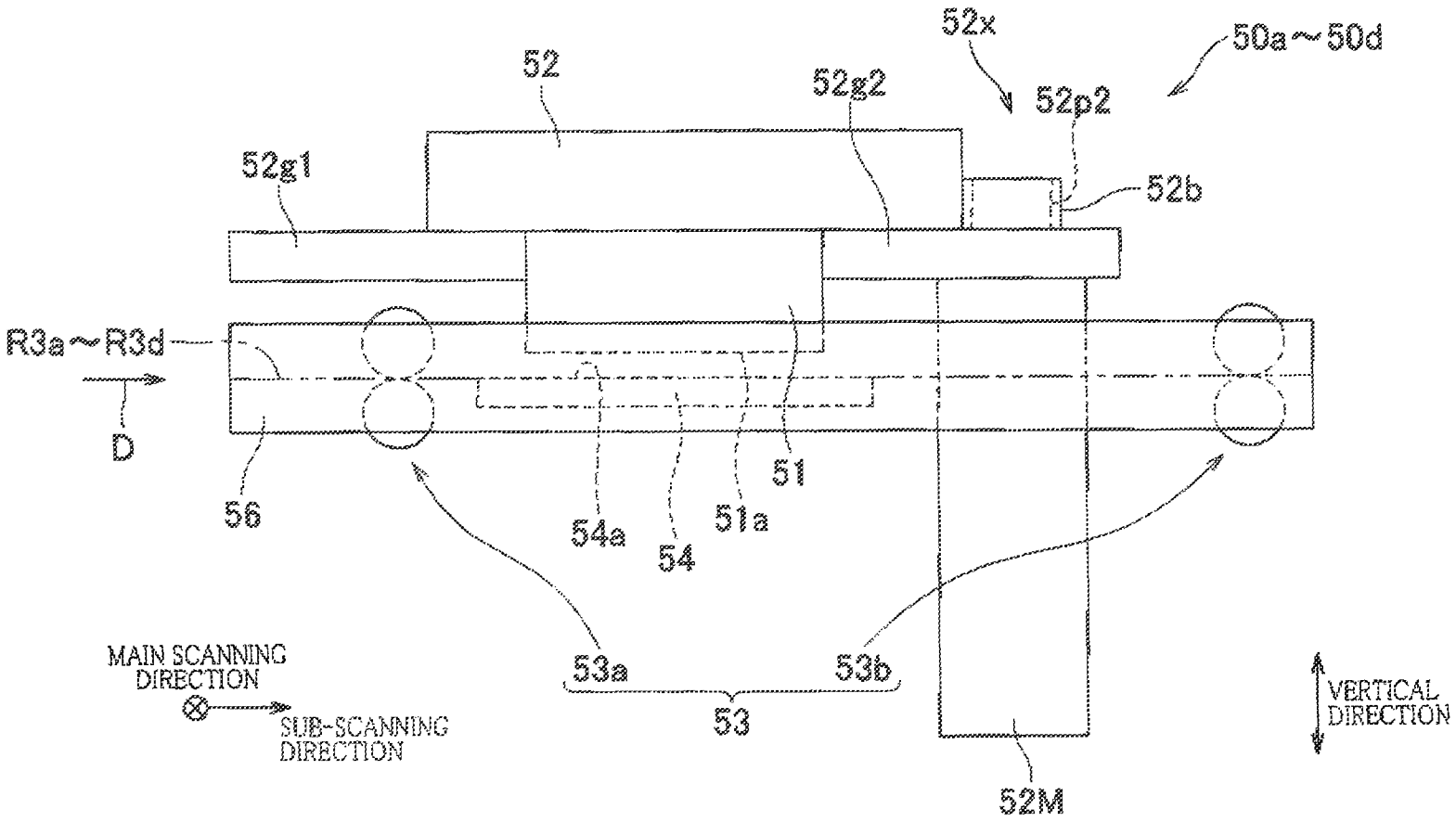
FIG. 5 is a side view of the recording module of the printer illustrated in FIG. 1.

There will be next explained the recording modules 50*a*-50*d* with reference to FIGS. 3-5.

Each of the recording modules 50*a*-50*d* includes the head 51, a carriage 52, and an individual conveyor 53. Each of the individual conveyors 53 is a constituent element of a corresponding one of the third conveying portions 31*a*-31*d*.

The head 51 is a serial head having a generally rectangular parallelepiped shape and supported by the housing 1*a* via the carriage 52. An upper surface of the head 51 is fixed to the carriage 52. A lower surface of the head 51 is an ejection surface 51*a* having a plurality of ejection openings opening therein.

The carriage 52 is reciprocable in the main scanning direction by a carriage moving device 52*x*. The carriage 52 supports the head 51 and reciprocates the head 51 in the main scanning direction. The carriage moving device 52*x* includes guides 52*g*1, 52*g*2, pulleys 52*p*1, 52*p*2, a belt 52*b*, and a carriage motor 52M. Each of the guides 52*g*1, 52*g*2 has a rectangular shape when viewed in the vertical direction, and the guides 52*g*1, 52*g*2 are spaced apart from each other in the sub-scanning direction. An upper portion of the head 51 is interposed between the guides 52*g*1, 52*g*2 which respectively support opposite ends of the carriage 52 in the sub-scanning direction such that the carriage 52 is slidable in the main scanning direction. The pulleys 52*p*1, 52*p*2 are rotatably supported by opposite end portions of the guide 52*g*2 in the main scanning direction. The pulleys 52*p*1, 52*p*2 have the same diameter and are arranged at the same position in the sub-scanning direction. The belt 52*b* is an endless belt looped over the pulleys 52*p*1, 52*p*2 and travels by the rotation of the pulleys 52*p*1, 52*p*2. The carriage 52 is fixed to the belt 52*b*. The carriage motor 52M has a circular cylindrical shape elongated in the vertical direction and is fixed to a lower surface of the guide 52*g*2. A rotation shaft of the carriage motor 52M is mounted on the pulley 52*p*1 so as to extend in the vertical direction.

The pulley 52*p*1 is a drive pulley which is rotated forwardly and reversely by the carriage motor 52M driven by the controller 100. The rotation of the pulley 52*p*1 rotates the belt 52*b*. The pulley 52*p*2 is a driven pulley which is rotated by the rotation of the belt 52*b*. With the operations of the components and devices of the cordage moving device 52*x*, the carriage 52 supporting the head 51 is reciprocated in the main scanning direction. During this reciprocation, the controller 100 controls the head 51 to eject the ink from the ejection openings at desired timings to record an image on the sheet P.

Each of the individual conveyors 53 is configured to intermittently convey the sheet P along the corresponding one of the third paths R3*a*-R3*d* in the direction D and includes roller pairs 53*a*, 53*b* and an individual conveying motor 53M (see FIG. 6). The roller pairs 53*a*, 53*b* are rotated by the individual conveying motor 53M driven by the controller 100. This rotation conveys the sheet P in the direction D. The direction D is a direction parallel with the sub-scanning direction and directed from an upstream side to a downstream side of each of the third paths R3*a*-R3*d*. The roller pairs 53*a*, 53*b* extend in the main scanning direction and interpose the head 51 in the sub-scanning direction. That is in each of the third paths R3*a*-R3*d*, the roller pair 53*a* is disposed upstream of the head 51, and the roller pair 53*b* is disposed downstream of the head 51.

A platen 54 is disposed between the roller pairs 53*a*, 53*b* at a position opposite the ejection surface 51*a*. The platen 54 has a flat upper surface 54*a* which can support a lower surface of the sheet P. A space appropriate for recording is formed between the ejection surface 51*a* and the upper surface 54*a*.

The roller pairs 53*a*, 53*b* and the platen 54 are supported by a pair of flanges 56. The pair of flanges 56 extending in the sub-scanning direction are spaced apart from each other in the main scanning direction.

An upper one of two ram of the roller pair 53*b* is a spur roller provided with a plurality of spurs, in order not to deteriorate the image recorded on the sheet P when the roller pair 53*b* nips the sheet P.

The controller 100 controls each of the recording modules 50*a*-50*d* to perform (i) an intermittently conveying operation in which the sheet P is intermittently conveyed in the direction D by the individual conveyor 53 based on signals output from a corresponding one of the sensors 6*a*-6*d* and image data contained in a recording command and (ii) a reciprocating operation in which, during a conveyance stopped period in which the sheet P is stopped in the intermittently conveying operation, the ink is ejected from the ejection openings while the carriage 52 is reciprocated in the sub-scanning direction. Specifically, the controller 100 starts recording by performing the intermittently conveying operation and the reciprocating operation when an amount of conveyance of the sheet P from the point in time when the leading edge of the sheet P has reached the corresponding one of the sensing positions 6*ap*-6*dp* has reached a predetermined amount based on count data of the ON counter of the corresponding one of the sensors 6*a*-6*d*. Here, the predetermined amount may be an amount of conveyance from the point in time when the leading edge of the sheet P has reached the corresponding one of the second sensing positions 6*ap*-6*dp* to a point in time when the sheet P has been conveyed to a position where a specific position on the sheet P which is defined by image data for recording on the sheet P and onto which the in is ejected in the first reciprocating operation is opposite the plurality of ejection openings 51*b* of the head 51. Also, the intermittently conveying operation is an operation in which a stopped sheet P is conveyed its the first direction by a predetermined amount (e.g., an amount corresponding to the length of an image, in the first direction, formed in a single reciprocating operation), and then the sheet P is stopped.

The roller pair 53*b* is a one-way roller. That is, rotational power of the roller pair 53*a* is transmitted to the roller pair 53*b*, but rotational power of the roller pair 53*b* is not transmitted to the roller pair 53*a*. Accordingly, while the image-recorded sheet P is successively conveyed toward the sheet receiver 4 by successive drivings of the roller pair 53*b*, the next sheet P can be intermittently conveyed in a corresponding one of the third paths R3*a*-R3*d* by intermittent drivings of the roller pair 53*a*. This configuration can improve a throughput. In a configuration in which the roller pair 53*b* is not the one-way roller, but the roller pairs 53*a*, 53*b* are driven in complete synchronization with each other, unlike the present embodiment, when a leading edge of the next sheet P reaches the roller pair 53*a* in the corresponding one of the third paths R1*a*-R1*d* before a trailing edge of the sheet P reaches a downstream side of the roller pair 53*b*, the roller pairs 53*a*, 53*b* are both driven intermittently; so that the image-recorded sheet P cannot be successively conveyed toward the sheet receiver 4 by the roller pair 53*a*.

Figure 7:
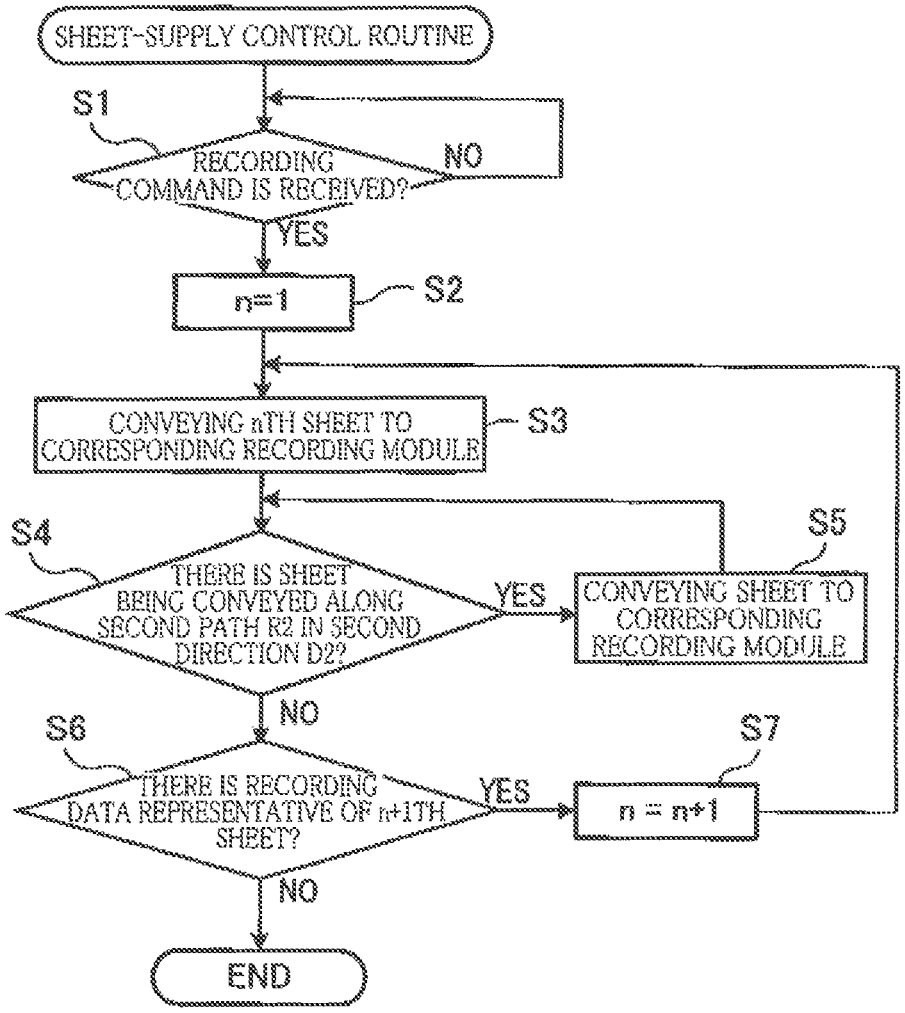
FIG. 7 is a flow chart illustrating a sheet-supply control routine to be executed by a controller of the printer illustrated in FIG. 1.
Figure 8:
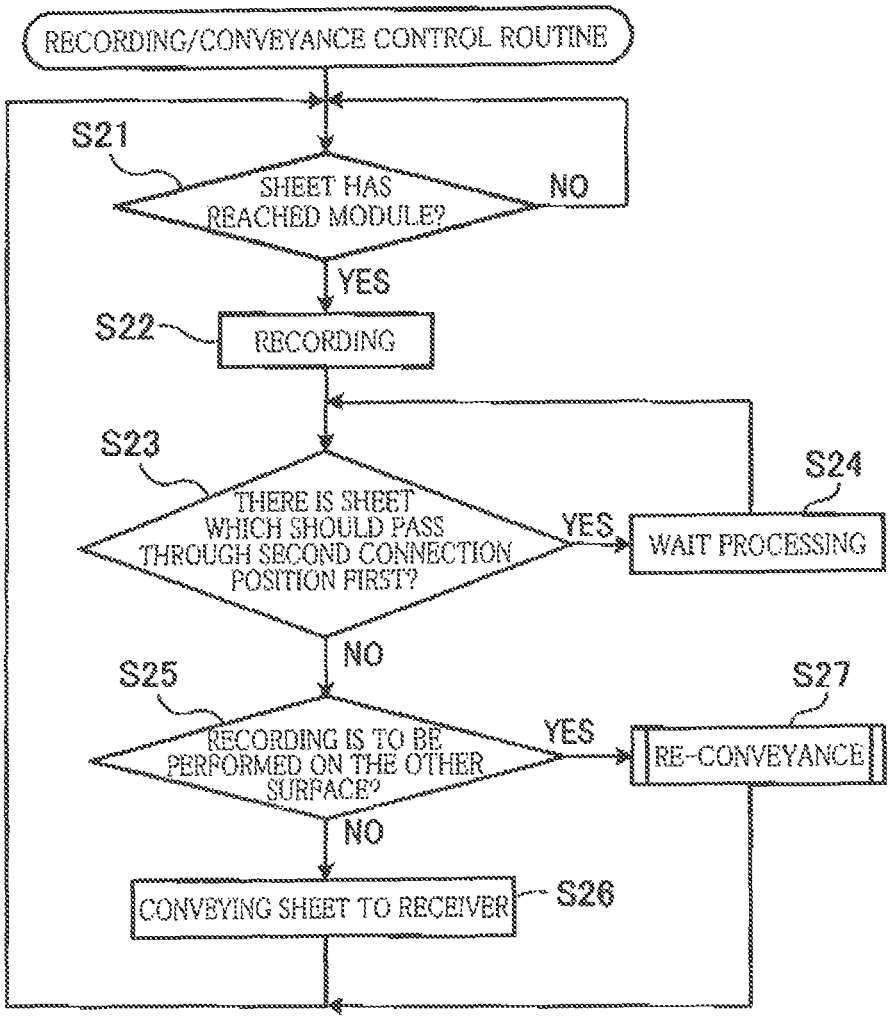
FIG. 8 is a flow chart illustrating a recording/conveyance control routine to be executed by the controller of the printer illustrated in FIG. 1.
Figure 9:
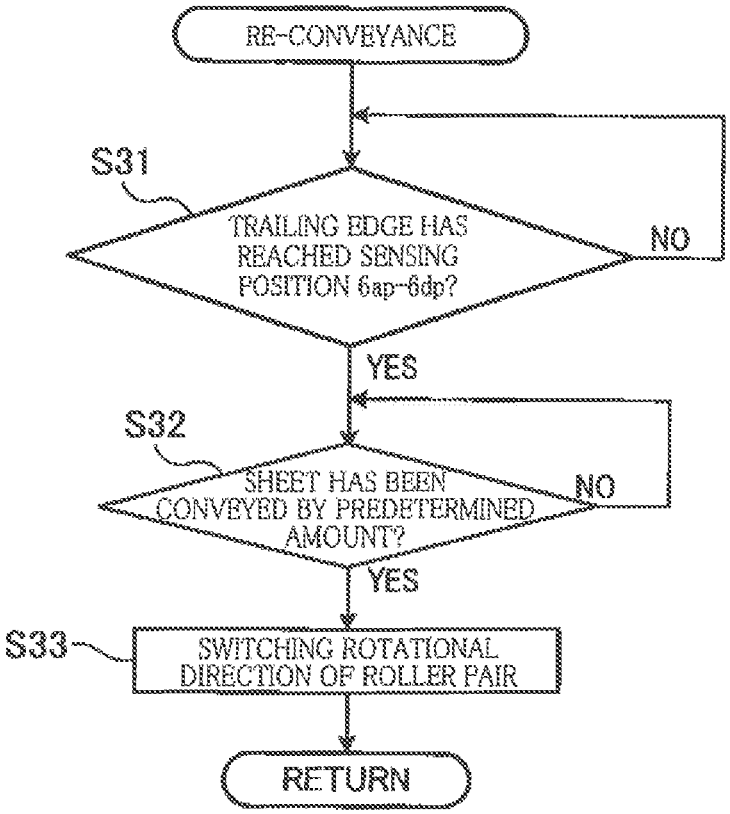
FIG. 9 is a flow chart illustrating a processing at S27 illustrated in FIG. 8.

There will be next explained processings executed by the controller 100 with reference to flow charts in FIGS. 7-9.

When the printer 1 is turned on, the controller 100 executes a sheet-supply control routine (see FIG. 7) and a recording/conveyance control routine (see FIG. 8) in parallel. The recording/conveyance control routine is executed for the recording modules 50*a*-50*d* in parallel.

In the sheet-supply control routine, the controller 100 determines whether a recording command has been received from the external device or not. When the recording command is not received (S1: NO), the controller 100 repeats the processing at S1. When the recording command is received (S1: YES), the controller 100 at S2 sets a variable n to one and at S3 conveys the nth sheet P to the corresponding recording module. The corresponding recording module is one of the four recording modules 50*a*-50*d*. One of the recording modules 50*a*-50*d*, to which the nth sheet P is to be supplied (i.e., the corresponding recording module for the nth sheet P or a destination of the supplied sheet P) will be explained later in detail with reference to FIG. 12. The controller 100 at S3 controls the sheet-supply motor 22M, the upstream conveying motor 26M, and the switching motors 28*a*M-28*c*M to supply an uppermost one of the sheets P stored in the sheet storage 3 as the nth sheet P to the corresponding recording module along the first path R1 and a corresponding one of the third paths R3*a*-R3*d*.

After S3, the controller 100 at S4 determines whether there is a sheet P being conveyed along the second path R2 in the second direction D2 or not. The controller 100 at S4 checks whether a value of a back-surface-recording waiting-sheet presence flag stored in the RAM is "1" or not. When the value of the flag is "1", the controller 100 determines that there is a sheet P being conveyed along the second path R2 in the second direction D2. When the value of the flag is "0", the controller 100 determines that there is no sheet P being conveyed along the second path R2 in the second direction D2.

When there is a sheet P being conveyed along the second path R2 in the second direction D2 (S4: YES), the controller 100 at S5, conveys the sheet P being conveyed in the second direction D2, to the corresponding recording module. After S5, the controller 100 sets the back-surface-recording waiting-sheet presence flag to "0", and this flow returns to S4.

When the controller 100 determines that there is no sheet P being conveyed along the second path R2 in the second direction D2 (S4: NO), the controller 100 determines whether there is recording data representative of an n+1th sheet P or not based on the recording command received at S1. When there is no recording data representative of the n+1th, sheet P (S6; NO), this flow ends. When there is recording data representative of the n+1th sheet P (S6: YES), the controller 100 at S7 sets the variable n to n+1, and this flow returns to S3.

In the recording/conveyance control routine, as illustrated in FIG. 8, the controller 100 at S21 determines, based on the signals output from the sensors 6*a*-6*d*, whether the sheet P has reached the corresponding one of the recording modules 50*a*-50*d* or not (that is, the controller determines whether the leading edge of the sheet P has reached the roller pair 53*a* of the corresponding one of the recording modules 50*a*-50*d* or not). When the sheet P has not reached the corresponding one of the recording modules 50*a*-50*d* (S21: NO), the controller 100 repeats the processing at S21. When the sheet P has reached the corresponding one of the recording modules 50*a*-50*d* (S21: YES), the controller 100 at S22 controls the corresponding one of the recording modules 50*a*-50*d*, to perform image recording OR the sheet P. At S22, the controller 100, based on the signals output from the sensors 6*a*-6*d* and image data contained in the recording command, controls the head S1, the carriage motor 52M, and the individual conveying motor 53M included in the corresponding one of the recording modules 50*a*-50*d* to perform the intermittently conveying operation and the reciprocating operation to record an image on the sheet P. In this recording, an image is recorded on one surface of the sheet P which faces the head 51.

After S22, the controller 100 at S23 determines whether there is a sheet P which should be conveyed through the corresponding one of the second connection positions R2*a*-R2*d* along the second path R2 in the second direction D2 before the leading edge of the nth sheet P conveyed along the corresponding one of the third paths R3*a*-R3*d* reaches the corresponding one of the second connection positions R2*a*-R2*d* which corresponds to the corresponding one of the recording modules 50*a*-50*d*.

When there is a sheet P which should be conveyed through the corresponding second connection position first (S23: YES), the controller 100 at S24 executes a wait processing. The wait processing at S24 is a processing in which the controller 100 controls the individual conveyor 53 of the corresponding one of the recording modules 50*a*-50*d* to cause the nth sheet P conveyed by the individual conveyor 53 to wait in the corresponding third path. After S24, this flow returns to S23.

When there is no sheet P which should be conveyed through the corresponding second connection position first (S23: NO), the controller 100 at S25 determines whether image recording is to be performed on the other surface of the sheet P (i.e., a surface of the sheet P which is opposite its surface facing the head 51) or not based on the recording command received at S1.

When no image recording is to be performed on the other surface of the sheet P (S25: NO), the controller 100 at S26 controls the downstream conveying motor 36M to convey the nth sheet P along the second path R2 in the first direction D1 onto the sheet receiver 4, and this flow returns to S21.

When image recording is to be performed on the other surface of the sheet P (S25: YES), the controller 100 at S27 performs re-conveyance of the nth sheet P. The controller at S27 controls the downstream conveying motor 36M to convey the nth sheet P along the second path 112 in the first direction D1 and switches the conveying direction of the sheet P (i.e., a direction in which the sheet P is conveyed) from the first direction D1 to the second direction D2 to convey the sheet P along the second path R2 in the second direction D2 and then convey the sheet P into the first path R1 via at least one of the second connection positions R2*a*-R2*d* and the other cod R2*y*. The sheet P conveyed into the first path R1 again has been turned upside down when compared with a state in which the sheet P is conveyed through the first path R1 for the first time.

In the re-conveyance at S27, as illustrated in FIG. 9, the controller 100 at S31 determines whether the trailing edge of the nth sheet P, has reached the corresponding one of the sensing positions 6*ap*-6*dp* on the corresponding one of the third paths R3*a*-R3*d*. When the trailing edge has not reached the corresponding one of the sensing positions 6*ap*-6*dp* (S31: NO), the controller 100 repeats the processing at S31. When the trailing edge has reached the corresponding one of the sensing positions 6*ap*-6*dp* (S31: YES), the controller 100 at S32 determines whether the nth sheet P has been conveyed by a predetermined amount or not. That is, the controller determines whether an amount of conveyance of the sheet P from a point in time when the trailing edge of the nth sheet P has reached the corresponding one of the sensing positions 6*ap*-6*dp* has reached a distance Lx (i.e., a predetermined conveyance amount) or not. The amount of conveyance is calculated based on count data created by the OFF counter of the corresponding one of the sensors 6*a*-6*d*, The distance Lx is a distance between the corresponding one of the sensing positions 6*ap*-6*dp* and a position located just upstream of the moat downstream roller pair on a downstream side of the corresponding one of the second connection positions R2*a*-R2*d* in the first direction D1 along the corresponding third path and the second path R2 (see FIGS. 10 and 11).

When the nth sheet P has not been conveyed by the predetermined amount (S32: NO), the controller 100 repeats the processing at S32. When the nth sheet P has been, conveyed by the predetermined amount (S32: YES), the controller 100 at S33 switches the rotational direction of the roller pairs 36*a*-36*i* from the forward direction to the reverse direction. As a result, the conveying direction of the sheet P is switched from the fast direction D1 to the second direction D2. The controller 100 sets the back-surface-recording waiting-sheet presence flag to "1" at generally the same timing as in the processing at S33.

Figure 10:
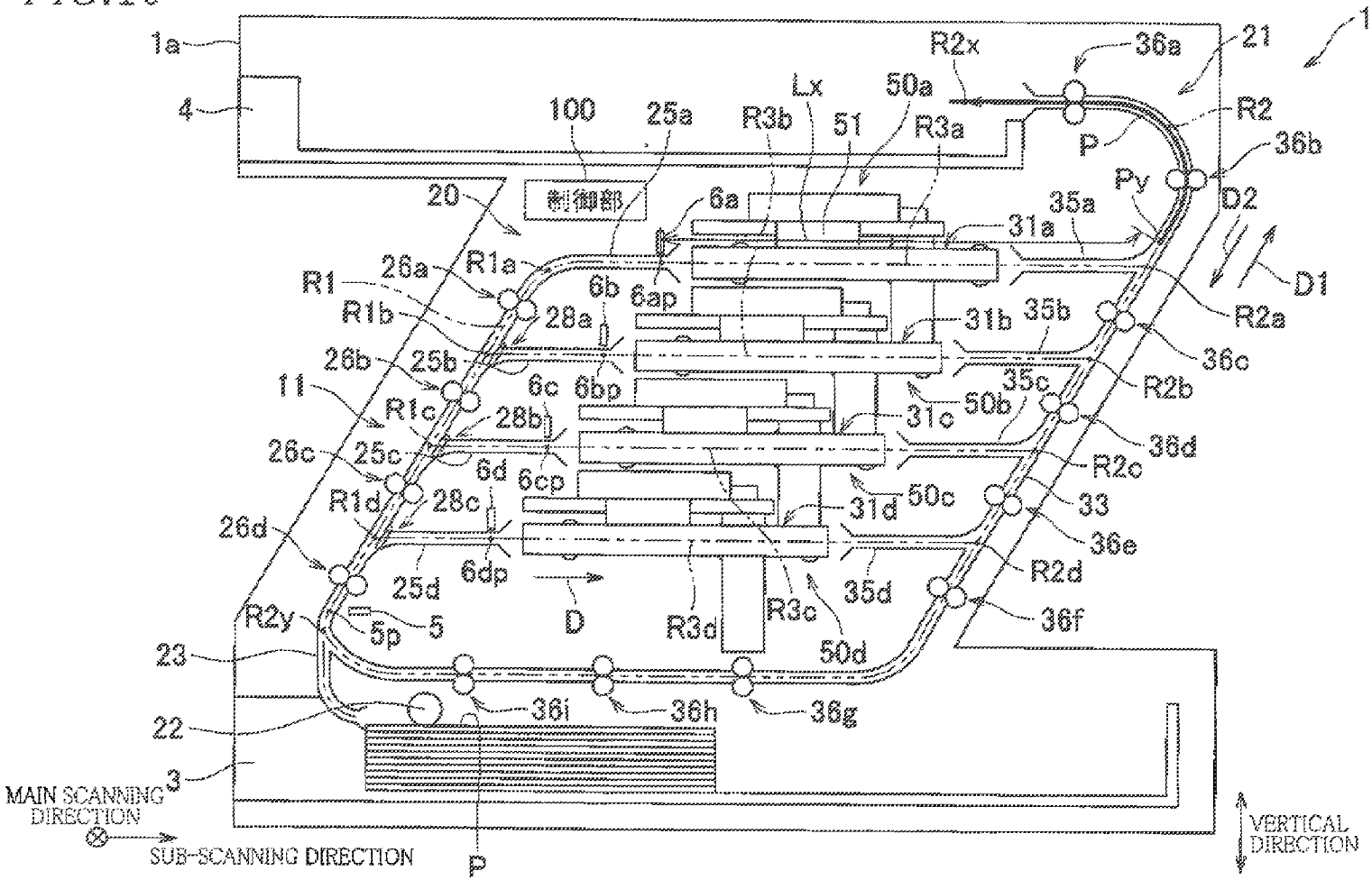
FIG. 10 is a schematic side view, corresponding to FIG. 1, illustrating a timing of switch of the conveying direction upon re-conveyance for a sheet whose front surface has been printed by the uppermost recording module.

In the case where the image recording has been performed on the front surface of the nth sheet P by the recording module 50*a* (that is, in a case where the corresponding recording module at S3 is the recording module 50*a*), as illustrated in FIG. 10, the controller 100 at S33 switches the rotational direction of the roller pairs 36*a*-36*i* when a trailing edge Py of the sheet P in the first direction D1 is located on the second path R2 at a position located downstream of the second connection position R2*a* in the first direction D1 and upstream of the roller pair 36*b* in the first direction D1.

Figure 11:
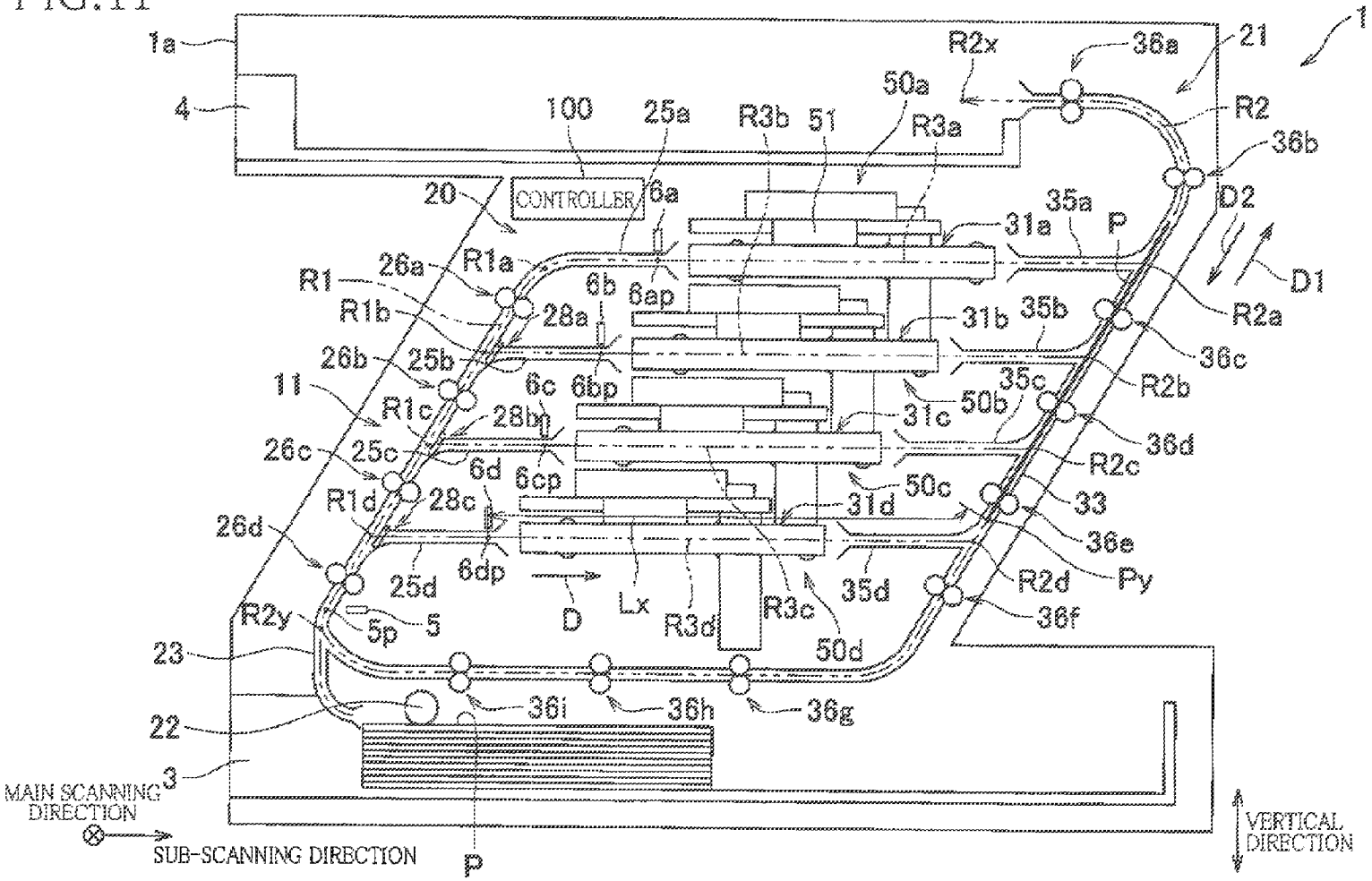
FIG. 11 is a schematic side view, corresponding to FIG. 1, illustrating a timing of switch of the conveying direction upon re-conveyance for a sheet whose front surface in been printed by the lowermost recording module.

In the case where the image recording has been performed on the front Surface of the nth sheet P by any one of the recording modules 50*b*-50*d* (that is, in a case where the corresponding recording module at S3 is any one of the recording modules 50*b*-50*d*), the controller 100 at S33 switches the rotational direction of the roller pairs 36*a*-36*i* when the trailing edge of the sheet P in the first direction D1 is located on the second path R2 at a position located downstream, in the first direction D1, of one of the second connection positions R2*b*-R2*d* which corresponds to the corresponding recording module and upstream, in the first direction D1, of a first roller pair (i.e., one of the roller pairs 36*c*-36*e*) adjacent to the corresponding one of the second connection positions R2*b*-R2*d* in the first direction D1 Specifically, in the case where the image recording has been performed on the front surface of the nth sheet P by the recording module 50*b*, the controller 100 switches the rotational direction of the roller pairs 36*a*-36*i* when the trailing edge of the sheet P in the first direction D1 is located on the second path R2 at a position located downstream of the second connection position R2*b* in the first direction D1 and upstream of the roller pair 36*e* in the first direction D1. In the case where the image recording has been performed on the front surface of the nth sheet P by the recording module 50*c*, the controller 100 switches the rotational direction of the roller pairs 36*a*-36*i* when the trailing edge of the sheet P in the first direction D1 is located on the second path R2 at a position downstream of the second connection position R2*c* in the first direction D1 and upstream of the roller pair 36*d* in the first direction D1. In the case where the image recording has been performed on the front surface of the nth sheet P by the recording module 50*d*, as illustrated in FIG. 11, the controller 100 switches the rotational direction of the roller pairs 36*a*-36*i* when the trailing edge Py of the sheet P in the first direction D1 is located on the second path R2 at a position located downstream of the second connection position R2*d* in the first direction D1 and upstream of the roller pair 36*e* in the first direction D1.

After S33, the flow at S27 ends, and the controller 100 executes the processing at S21 again. At S21 after S27, the controller 100 controls the upstream conveying motor 26M and the switching motors 28*a*M-28*c*M, without driving the sheet-supply motor 22M, to supply the sheet P having been conveyed from the other end R2*y* into the first path R1, to the corresponding recording module along the first path R1 and a corresponding one of the third paths R3*a*-R3*d*. This corresponding recording module is the same as the recording module used at the first processing at S21 (i.e., in the recording on the front surface). That is, the same recording module is used for the same sheet P upon image recording on its front surface and back surface.

Figure 12:
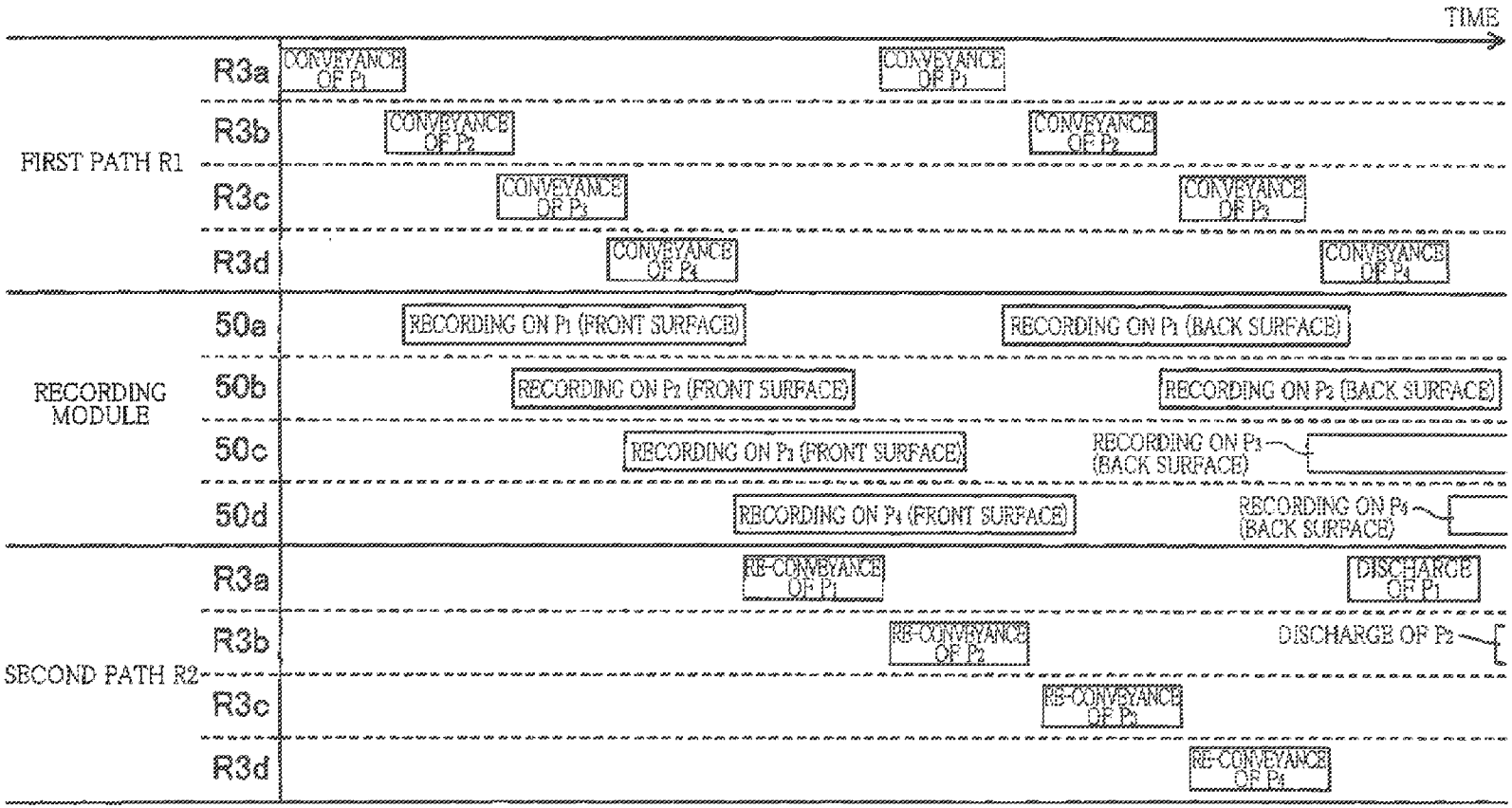
FIG. 12 is a time chart illustrating conveyance and recording in a case where duplex recording is successively performed on a plurality of sheets having the A4 size or the letter size.

There will be next explained, with reference to FIG. 12, a destination of supply of each sheet P and a situation of conveyance and recording on each sheet P when duplex recording is successively performed on a plurality of sheet P.

In the case where the sheet P is of the A4 size or the letter size, the recording modules 50*a*-50*d* are used in order from the upper module. Specifically, in a case where simplex image recording (i.e., recording on only a front surface of each sheet) is successively performed on a plurality of sheets P of the A4 size or the letter size, the first sheet P is supplied to the recording module 50*a*, the second sheet P to the recording module 50*b*, the third sheet P to the recording module 50*c*, and the fourth sheet P to the recording module 50*d*. Like the first sheet P, the fifth sheet P is supplied to the recording module 50*a*. In the case where the duplex recording (i.e., recording on a front surface and a back surface of each sheet) is successively performed on the plurality sheets P of the A4 size or the letter size, the first sheet P is supplied to the recording module 50*a*, the second sheet P to the recording module 50*b*, the third sheet P to the recording module 50*c*, and the fourth sheet P to the recording module 50*d* in both of the recording on the front surface and the recording on the back surface. Like the first sheet P, the fifth sheet P is supplied to the recording module 50*a*.

In FIG. 12, the nth sheet (n=1-4) is indicated by "$P_a$". The string "R3*a*" in the "FIRST PATH R1" section in FIG. 12 means conveyance along the first path R1 and the third path R3*a*, the string "R3*b*" in the "FIRST PATH R1" section means conveyance along the first path R1 and the third path R3*b*, the string "R3*c*" in the "FIRST PATH R1" section means conveyance along the first path R1 and the third path R1*c*, and the string "R3*d*" in the "FIRST PATH R1" section means conveyance along the first path R1 and the third path R3*d*. The string "R3*a*" in the "SECOND PATH R2" section means re-conveyance of the sheet P having been conveyed from the third path R3*a* to the second path R2, the string "R3*b*" in the "SECOND PATH R2" section means re-conveyance of the sheet P having been conveyed from the third path R3*b* to the second path R2, the string "R3*c*" in the "SECOND PATH R2" section means re-conveyance of the sheet P having been conveyed from the third path R1*c* to the second path R2, and the string "R3*d*" in the "SECOND PAIR R2" section means re-conveyance of the sheet P having been conveyed from the third path R3*d* to the second path R2.

In the case where the sheet P is of the A3 size, the uppermost recording module 50*a* and the third recording module 50*c* from the top are repeatedly used in this order. Specifically in a case where the simplex recording is successively performed on the plurality of sheets P of the A3 size, the first sheet P is supplied to the recording module 50*a*, the second sheet P to the recording module 50*c*, the third sheet P the recording module 50*a* and the fourth sheet P to the recording module 50*c*. In a case where the duplex recording is successively performed on the plurality of sheets P of the A3 size, the first sheet P is supplied to the recording module 50*a*, the second sheet P to the recording module 50*c*, the third sheet P to the recording module 50*a*, and the fourth sheet P to the recording module 50*c* in both of the recording on the front surface and the recording on the back surface.

The recording module to which the sheet P is to be supplied (i.e., the destination of the supplied sheet P) is determined by the controller 100 having referred, after the reception of the recording command (S1: YES), to information contained in the recording command which represents the size and the number of sheets P and to a table representing correspondence between a destination of the supply and the size and the number of sheets P. This table is stored in the ROM, for example.

In the present embodiment as described above, the other end R2*y* of the second path R2 is connected to a portion of the first path R1 which is located upstream of the four first connection positions R1*a*-R1*d* (see FIG. 1). Also, the second path R2 is defined such that the sheet P is conveyed through the second path R2 into the first path R1 in a state in which the sheet P is flipped when compared with a state in which the sheet P conveyed via the second path R2 is most recently conveyed through the first path R1. This construction of the paths can reduce the size of the second path R2 and accordingly reduce the size of the printer 1.

The recording apparatus according to the present invention differs from the conventional recording apparatus in a construction of path through which a recording medium is conveyed after recording on the first surface and before recording on the second surface. Specifically, after the recording on the first surface and before the recording on the second surface, in the present invention, the recording medium is conveyed in the second path in the first direction, than the conveying direction of the sheet P is switched, and the sheet P is conveyed in the second path in the second direction via the plurality of second connection positions and conveyed into the first path again. In the conventional recording apparatus, on the other hand, after the recording on the first surface and before the recording on the second surface, the recording sheet is conveyed into the flip path portion via the joining position of the three conveyance paths, then flipped by the flip path portion, and conveyed into the sheet-supply path again without passing through the joining position. That is, in the conventional recording apparatus, the recording sheet P is conveyed only one direction (i.e., a down direction) at the joining position of the three conveyance paths and conveyed in opposite directions in the flip path portion formed between the joining position and the output tray. This construction makes it difficult to reduce the size of the flip path portion, preventing downsizing of the apparatus. In the present invention, however, the recording medium is conveyed in opposite directions in the second path and conveyed in the second direction via the plurality of second connection positions, making it possible to reduce the size of the second path and accordingly reduce the size of the apparatus.

The conveying unit 20 includes the first conveying portion 11, the second conveying portion 21, and the four third conveying portions 31*a*-31*d*. The controller 100 controls the four recording modules 50*a*-50*d*, the first conveying portion 11, the second conveying portion 21, and the four third conveying portions 31*a*-31*d*. With this configuration, the sheet P can be reliably conveyed along each path.

The second conveying portion 21 can convey the sheet P in the second path R2 in the first direction D1 and the second direction D2. This configuration allows effective recording on the front surface and the back surface of the sheet P.

The second path R2 is defined such that the sheet P conveyed by the second conveying portion 21 in the second direction D2 is conveyed via the second connection positions R2*a*-R2*d* and the other end R2*y* into the first path R1. This construction can reduce the size of the second path R2 and accordingly reduce the size of the printer 1 more reliably.

The controller 100 controls the second conveying portion 21 to switch the conveying direction of the sheet P from the first direction D1 to the second direction D2 when the trailing edge Py, in the first direction D1, of the sheet P whose front surface has been printed by one of the recording modules 50*b*-50*d* (i.e., the second recording module) is located on the second path R2 at a position located downstream, in the first direction D1, of one of the second connection positions R2*b*-R2*d* which corresponds to the corresponding recording module and upstream of the second connection position R2*a* in the first direction D1 (see FIG. 11). This configuration can increase the speed of recording.

Also, the controller 100 controls the second conveying portion 21 to switch the conveying direction of the sheet P from the first direction D1 to the second direction D2 when the trailing edge Py, in the first direction D1, of the sheet P whose front surface has been printed by one of the recording modules 50*b*-50*d* the second recording module) is located on the second path R2 at a position located downstream, in the first direction D1, of one of the second connection positions R2*b*-R2*d* which corresponds to the corresponding recording module and upstream, in the first direction D1, of the second connection position (e.g., the second connection position R2*c* in the case where the corresponding second connection position is the second connection position R2*d*) adjacent in the first direction D1 to one of the second connection positions R2*b*-R2*d* which corresponds to the corresponding recording modules (see FIG. 11). This configuration can further increase the speed of recording.

Also, the controller 100 controls the second conveying portion 21 to switch the conveying direction of the sheet P from the first direction D1 to the second direction D2 when the trailing edge Py in the first direction D1, of the sheet P whose front surface has been printed by one of the recording modules 50*b*-50*d* (i.e., the second recording module) is located on the second path R2 at a position located downstream, in the first direction D1, of one of the second connection positions R2*b*-R2*d* which corresponds to the corresponding recording module and upstream, in the first direction D1, of a first roller pair (e.g., the roller pair 36*e* in the case where the corresponding second connection position is the second connection position R2*d*) adjacent in the first direction D1 to one of the second connection positions R2*b*-R2*d* which corresponds to the corresponding recording modules (see FIG. 11). This configuration can increase the speed of recording and prevent occurrence of situation in which the leading edge of the sheet P conveyed in the second direction D2 (i.e., the trailing edge of the sheet P in the first direction D1) is caught by the first roller pair to cause a sheet jam. More specifically, a sheet jam easily occurs in a portion of a path in which the roller pair is provided than in a portion of the path in which no roller pair is provided (i.e., the portion of the path which is defined by the guide). To prevent occurrence of sheet jam, in the present embodiment, the rotational direction of the roller pair is switched when the trailing edge of the sheet P in the first direction D1 is located upstream of the roller pair in the first direction D1 (that is, a leading edge portion of the sheet P during its conveyance in the second direction is nipped by the roller pair). This configuration can prevent occurrence of sheet jam.

The controller 100 controls the second conveying portion 21 to switch the conveying direction of the sheet P from the first direction D1 to the second direction D2 when the trailing edge Py, in the first direction D1, of the sheet P who front surface has been printed by the recording module 50*a* is located on the second path R2 at a position located downstream of the second connection position R2*a* in the first direction D1 and upstream of the roller pair 36*b* in the first direction D1 (see FIG. 10). This configuration can increase the speed of recording and prevent occurrence of situation in which the leading edge of the sheet P conveyed in the second direction D2 (i.e., the trailing edge of the sheet P in the first direction D1) is caught by the roller pair 36*b* to cause a sheet jam.

In the control for re-conveyance (S27), the controller 100 controls the second conveying portion 21 based on the signals output from the sensors 6*a*-6*d* to switch the conveying direction of the sheet P from the first direction D1 to the second direction D2 (see FIG. 9). In the control for recording (S22), the controller 100 controls the recording modules 50*a*-50*d* based on the signals output from the sensors 6*a*-6*d* and the image data contained in the recording command, to perform the intermittently conveying operation and the reciprocating operation. With this configuration, the controller 100 can determine, based on the signals output from the sensors 6*a*-6*d*, not only the timing of switch of the conveying direction but also the timing of recording in the recording modules 50*a*-50*d*, for example. The sensors 6*a*-6*d* are thus given a plurality of roles, resulting in reduced cost.

The controller 100 executes the control such that the recordings on the front surface and the back surface of the same sheet P are performed by the same recording module (see FIG. 12). This configuration can improve operation efficiency of the recording modules 50*a*-50*d* and accordingly improve the speed of recording on a plurality of sheets P. That is, to improve operation efficiency of the entire recording modules 50*a*-50*d*, it is effective to immediately supply a next sheet P after the recording module finishes recording an image on the front surface. Here, in the case of the duplex recording, the above-described next sheet P is naturally the sheet P whose front surface has been printed by the same recording modules. Accordingly, the same recording module is preferably used to perform recording on the front surface and the back surface in the case of the duplex recording as described above to improve operation efficiency of the recording modules 50*a*-50*d* and accordingly improve the speed of recording on a plurality of sheets P.

The controller 100 executes the determination processing at S23, and when there is a sheet P which should be conveyed through the second connection position first (S23: YES), the controller 100 executes the wait processing at S24 (sec FIG. 8). This configuration enables high-speed recording using the four recording modules 50*a*-50*d* while preventing collision of the sheets P.

The sheet receiver 4 is disposed such that the four recording modules 50*a*-50*d* are interposed between the sheet receiver 4 and the sheet storage 3 in the vertical direction (see FIG. 1). That is, the sheet storage 3 and the sheet receiver 4 are disposed respectively on opposite sides of the four recording modules 50*a*-50*d*. In a case where the sheet storage 3 and the sheet receiver 4 are disposed on the same side of the four recording modules 50*a*-50*d*, the printer 1 requires the larger size when viewed in the vertical direction to provide enough spaces for the sheet storage 3 and the sheet receiver 4. In the present embodiment, however, the sheet storage 3 and the sheet receiver 4 are disposed respectively on opposite sides of the four recording modules 50*a*-50*d*, resulting in reduced size of the printer 1 when viewed in the vertical direction.

The other end R2*y* of the second path R2 is connected to the portion of the first path R1 which is located upstream of the sensing position 5*p* (see FIG. 1). With this configuration, the sensor 5 can sense both of the sheet P conveyed from the sheet storage 3 to the first path R1 and the sheet P conveyed to the first path R1 via the second path R2. Accordingly, there is no need to provide not only a sensor for sensing the sheet P conveyed from the sheet storage 3 to the first path R1 but also a sensor for sensing the sheet P conveyed to the first path R1 via the second path R2, resulting in fewer sensors.

Figure 13:
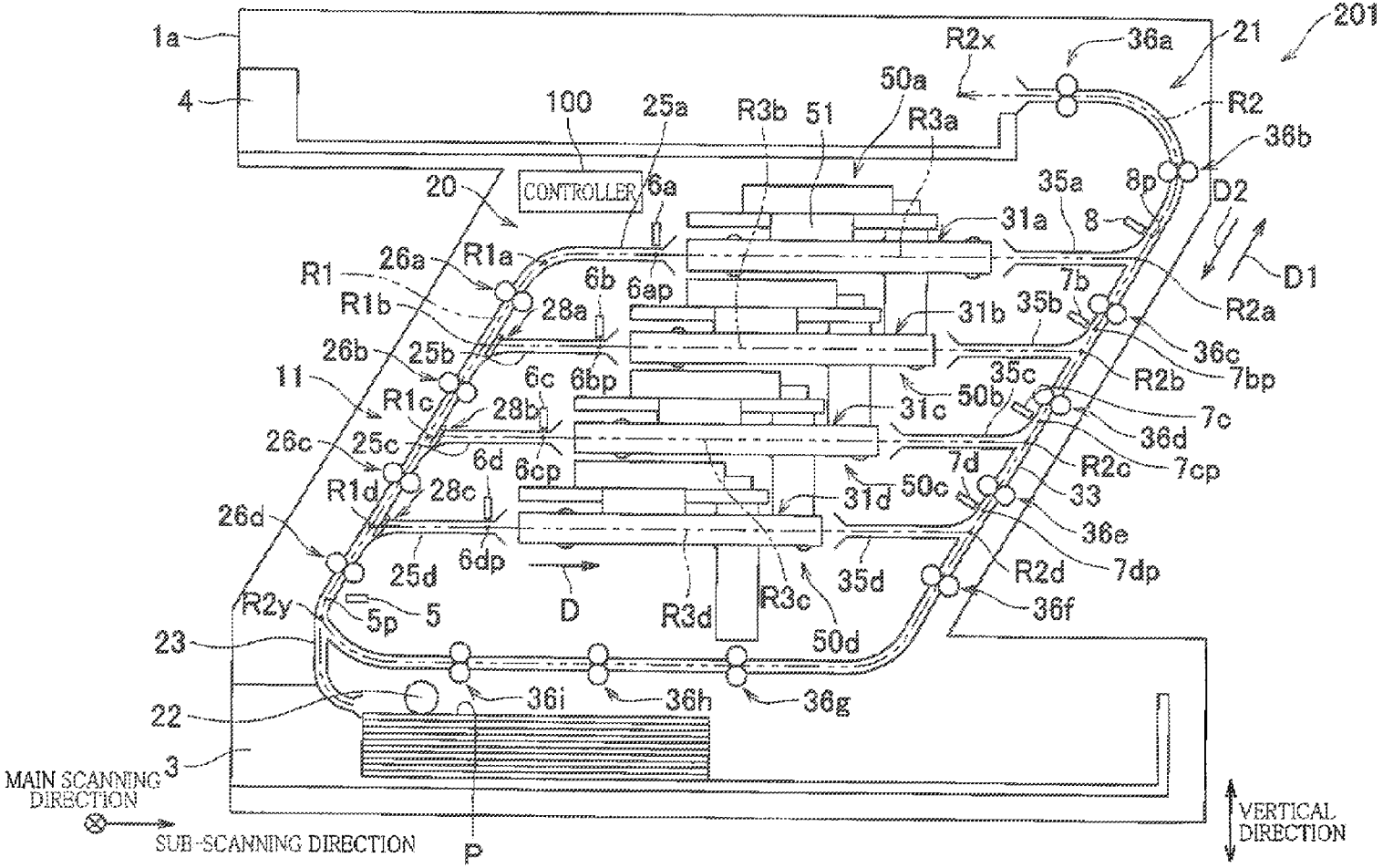
FIG. 13 is a schematic side view, corresponding to FIG. 1, illustrating an internal structure of an ink-jet printer according to a second embodiment of the present invention.
Figure 14:
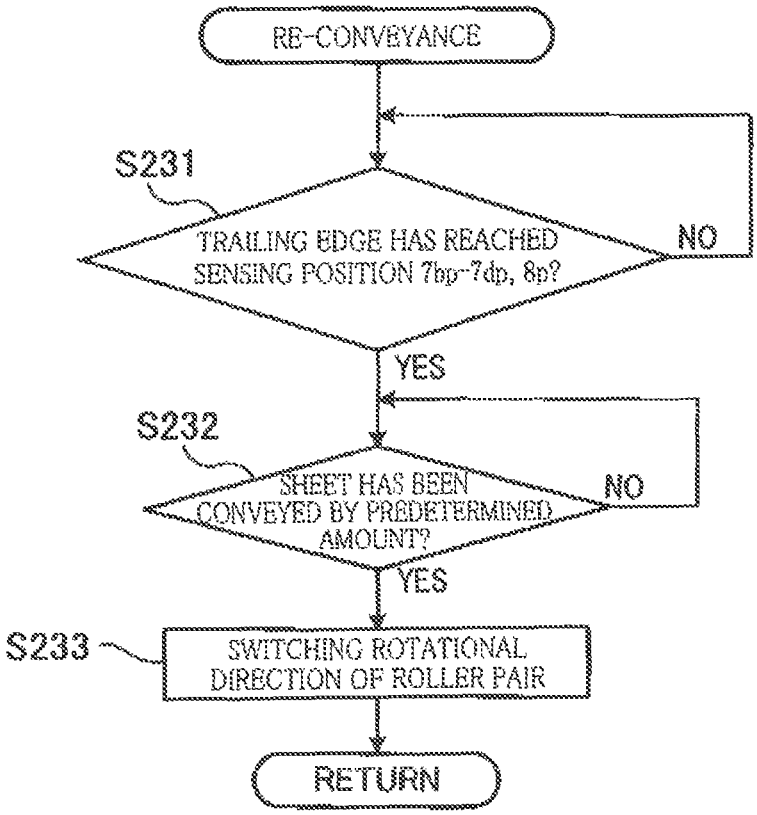
FIG. 14 is a flow chart illustrating a routine at S27 illustrated in FIG. 8 in the second embodiment of the present invention.

There will be next explained an ink-jet printer 201 according to the second embodiment of the present invention with reference to FIGS. 13 and 14.

As illustrated in FIG. 13, the printer 201 according to the second embodiment has the same construction as the printer 1 according to the first embodiment except for sensors 7*b*-7*d*, 8 included in the printer 201. It is noted that the same reference numerals as used in the first embodiment are used to designate the corresponding elements of the second embodiment, and an explanation of which is dispensed with.

Each of the sensors 7*b*-7*d*, 8 is configured to output a signal indicating the presence or absence of the sheet P at a corresponding one of sensing positions 7*bp*-7*dp*, 8*p*. Each of the sensors 7*b*-7*d*, 8 outputs an ON signal when there is a sheet P at the corresponding position, and outputs an OFF signal when there is no sheet P at the corresponding position. Each of the sensing positions 7*bp*-7*dp* is located on the second path R2 at a position located downstream, in the first direction D1, of one of the second connection positions R2*b*-R2*d* which corresponds to a corresponding one of the recording modules 50*b*-50*d* and upstream, in the first direction D1, of a first roller pair one of the roller pairs 36*a*-36*e*) adjacent in the first direction D1 to the one of the second connection positions R2*b*-R2*d* which corresponds to the corresponding second recording module. The sensing position 8*p* is located on the second path R2 at a position located downstream of the second connection position R2*a* in the first direction D1 and upstream of the roller pair 36*b* in the first direction D1.

In the control for re-conveyance at S27, the controller 100 controls the second conveying portion 21 to switch the conveying direction of the sheet P from the first direction D1 to the second direction D2 not based on the signals output from the sensors 6*a*-6*d* but based on signals output from the sensors 7*b*-7*d*, 8. Specifically, for the sheet P whose front surface has been printed by the recording module 50*a*, the controller 100 switches the rotational direction of the roller pairs 36*a*-36*i* based on signals output from the sensor 8, and for the sheet P whose front surface has been printed by any one of the recording modules 50*b*-50*d*, the controller 100 switches the rotational direction of the roller pairs 36*a*-36*i* based on signals output from a corresponding one of the sensors 7*b*-7*d*.

More specifically, in the control at S27 as illustrated in FIG. 14, the controller 100 at S231 determines whether the trailing edge of the sheet P whose front surface has been printed by the recording module 50*a* has reached the sensing position 8*p* or not and determines whether the trailing edge of the sheet P whose front surface has been printed by any one of the recording modules 50*b*-50*d* has reached the corresponding one of the sensing positions 7*bp*-7*dp* or not. When the trailing edge has not reached the sensing position (S231: NO), the controller 100 repeats the processing at S231. When the trailing edge has reached the sensing position (S231: YES), the controller 100 at S232 determines whether the sheet P has been conveyed by a predetermined amount or not. That is, the controller determines whether an amount of conveyance of the sheet P from a point in time when the trailing edge of the sheet P has reached the corresponding sensing position has reached, a distance Lx (i.e., a predetermined conveyance amount) or not. In the present embodiment, the amount of conveyance is calculated based on count data created by the OFF counter of the corresponding one of the sensors 7*b*-7*d*, 8. In the case where the corresponding sensing position is the sensing position 8*p*, the distance Lx is a distance shorter than a distance between the sensing position 8*p* and the roller pair 36*b* along the second path R2, and in the case where the corresponding sensing position is one of the sensing positions 7*bp*-7*dp*, the distance Lx is a distance shorter than a distance between the corresponding one of the sensing positions 7*bp*-7*dp* and the corresponding one of the roller pairs 36*c*-36*e* along the second path R2. The distance Lx in the present embodiment is shorter than the distance Lx in the first embodiment and may be zero, for example. In the case where the distance Lx is zero (Lx=0), the controller 100 determines that the sheet P has been conveyed by the predetermined amount (S232: YES), without calculating the amount of conveyance, at the point in time when the trailing edge of the sheet P has reached the corresponding sensing position.

When the sheet P has not been conveyed by the predetermined amount (S232: NO), the controller 100 repeats the processing at S232. When the sheet P has been conveyed by the predetermined amount (S232: YES), the controller 100 at S233 switches the rotational direction of the roller pairs 36*a*-36*i* from the forward direction to the reverse direction. As a result, the conveying direction of the sheet P is switched from the first direction D1 to the second direction D2. After S233, the flow at S27 ends, and the controller 100 executes the processing at S21 again (see FIG. 8).

In the present embodiment as described above, it is possible to improve accuracy of the timing of switch of the conveying direction. Also in the present embodiment, the same construction as employed in the first embodiment can achieve the same effects as obtained in the first embodiment.

Figure 15:
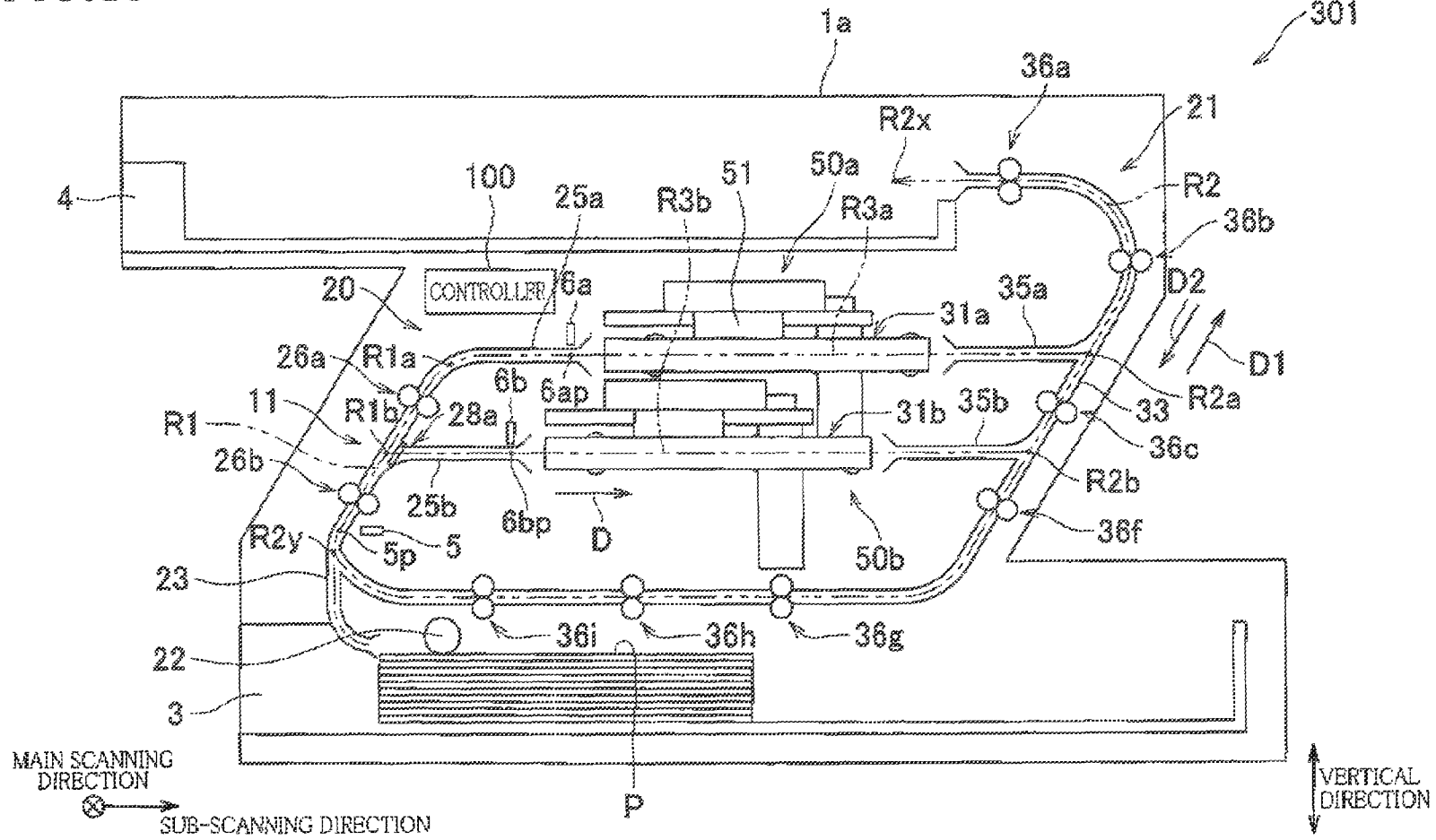
FIG. 15 is a schematic side view, corresponding to FIG. 1, illustrating an internal structure of an ink-jet printer according to a third embodiment of the present invention.

There will be next explained an ink-jet printer 301 according to a third embodiment of the present invention with reference to FIG. 15.

The printer 301 according to the third embodiment has the same construction as the printer 1 according to the first embodiment except for the number of recording modules and a construction of paths. It is noted that the same reference numerals as used in the first embodiment are used to designate the corresponding elements of the third embodiment, and an explanation of which is dispensed with.

The printer 301 includes two recording modules 50*a*, 50*b*. Two cartridges, not shown, are mountable on and removable from the housing 1*a*. The conveying unit 20 conveys the sheet P along the first path R1, the second path R2, and any one of the two third paths R3*a*, R3*b* and includes the first conveying portion 11, the second conveying portion 21, and two third conveying portions 31*a*, 31*b*.

Also in the third embodiment, the same construction as employed in the first embodiment can achieve the same effects as obtained in the first embodiment.

While the embodiments of the present invention have been described above, it is to be understood that the invention is not limited to the details of the illustrated embodiments, but may be embodied with various changes and modifications, which may occur to those skilled in the art, without departing from the spirit and scope of the invention.

The number of recording modules may be any number as long as a plurality of recording modules are provided. The recording modules are used in order from above in the above-described embodiment, but the present invention is not limited to this configuration. For example, the recording modules may be used in order from below and may be used in other orders.

The positional relationship between the recording modules is not limited in particular as long as the recording modules are arranged in one direction. For example, while the four recording modules 50*a*-50*d* are arranged at different positions in the sub scanning direction in the above-described embodiment the recording modules may be arranged without difference in positions in the sub-warning direction, that is, the recording modules may be arranged at the same position in the sub-scanning direction. Two recording modules adjacent to each other in the vertical direction may be arranged at different positions in a direction, in the plane of the third path, which differs from the sub-scanning direction (e.g., the main scanning direction). The plurality of recording modules may not be arranged in the vertical direction and may be arranged in the horizontal direction.

Recording modules assumed to be the first recording module and the second recording module among the plurality of recording modules may be changed as needed according to, e.g., the construction of the paths.

Another recording module may be disposed between the first recording module and the second recording module. The plurality of recording modules may have different constructions. For example, the plurality of recording modules may be different from each other in, e.g., recordable color, resolution, recording speed, recording method, type of recordable recording medium, and size of recordable recording medium.

The intersecting angle of a plurality of paths and the angle of a curved portion of one path may be any angles. For example, the guide 23 and each of the guides 25*a*-25*d* are not perpendicular to each other in the above-described embodiment but may be perpendicular to each other. Likewise, the guide 33 and each of the guides 35*a*-35*d* are not perpendicular to each other in the above-described embodiment but may be perpendicular to each other.

Relationship of position, angle, and so on between the plurality of paths may be any relationship. In the above-described embodiment, for example, the angles of the guide

23, 33 with respect to the vertical direction may or may not be the same as each other. The number of paths and the construction of each path may be changed according to the number and/or arrangement of recording modules.

The second path only needs to be defined such that the recording medium conveyed by the second conveying portion in the second direction is conveyed into the first path via at least one of the plurality of second connection positions and the other end of the second path. That is, when being returned from the second path into the first path, the recording medium only needs to be conveyed via at least one of the plurality of second connection positions and may not be conveyed via all the plurality of second connection positions.

The other end of the second path may not be connected to the portion of the first path which is located upstream of the fourth sensing position and may be connected to a portion of the first path which is the same position as the fourth sensing position or which is located downstream of the fourth sensing position.

The plurality of pivot members constituting the switcher may be driven by the same drive source and may be driven respectively by individual drive sources. The switcher may not include the pivot members used in the above-described embodiment. For example, the switcher may be configured to switch the path by applying an external force to the recording medium by, e.g., en electrostatic force or air without contacting the recording medium.

Each of the first to fourth sensors may be any type of sensor such as an optical sensor, a mechanical sensor, and a magnetic sensor. The first sensing position may be defined in a path formed in the recording module. Each of the first to fourth sensors is not essential for the present invention, and any or all of these sensors may be omitted. For example, the sensor 5 may be omitted in the first to third embodiments. The sensors 6*a*-6*d* may be omitted in the first and second embodiments. The sensors 6*a*, 6*b* may be omitted in the third embodiment.

Various components are employed for the conveying unit, depending upon the construction of the paths, for example. For example, in a case where the first path is short, the first conveying portion may be constituted by only the sheet-supply roller and the sheet-supply motor.

Any conveying unit other than the second conveying portion (e.g., the first conveying portion) may be configured to convey the recording medium in the first direction and the second direction. That is, the recording medium may be turned upside down in any area other than the second path.

The conveying unit may not be provided on each path. For example, components for conveying the recording medium along the third path may be disposed on the first path or the second path.

The plurality of roller pairs constituting the individual conveyor may be driven by the same drive source and may be driven respectively by individual drive sources. In the above-described embodiment, the roller pair 53*b* may not be the one-way roller, and the roller pairs 53*a*, 53*b* may be driven in complete synchronization with each other.

The controller may not execute the determination processing and the wait processing. Also, the conveying direction of the recording medium may be switched from the first direction to the second direction in the second path at any timing. For example, in the above-described embodiment, the controller 100 may switch the rotational direction of the roller pairs 36*a*-36*i* when the trailing edge Py of the sheet P whose front surface has been printed by the recording module 50*d* is located on the second path R2 at a position located downstream of the roller pair 36*e* in the first direction D1 and upstream of the second connection position R2*c* in the first direction D1. Alternatively, the controller 100 may switch the rotational direction of the roller pairs 36*a*-36*i* when the trailing edge Py of the sheet P whose front surface has been printed by the recording module 50*d* is located on the second path R2 at a position located downstream of the roller pair 36*c* in the first direction D1 and upstream of the second connection position R2*a*, in the first direction D1.

The timing when the back-surface-recording waiting-sheet presence flag is set to "0" or "1" may be changed as needed. While the same recording module performs image recording on the first surface and the second surface of the same recording medium in the above-described embodiments, different recording modules may perform image recording on the first surface and the second surface of the same recording medium.

A higher priority may be given to any of the plurality of paths for conveyance of the recording medium. The controller may determine, at any timing, combination of the recording mediums and paths to which the recording mediums are to be conveyed. The timing is not limited to a point in time between the reception of the recording command and the start of the conveyance of the recording medium and may be a point in time after the recording operation is started (e.g., a point in time after a start of conveyance of the preceding recording medium or a point in time between the start of conveyance of the recording medium and a start of operation of the switcher).

The recording medium is not limited to the sheet and may be any recording medium.

Each of the sheet storage and the sheet receiver may be disposed any position. For example, the sheet receiver may be disposed at a position at which only a part of the plurality of recording modules is interposed between the sheet receiver and the sheet storage in a direction of the arrangement of the recording modules. The sheet storage and the sheet receiver may be disposed on the same side of the plurality of recording modules. The sheet storage and/or the sheet receiver may be disposed at a position not overlapping any of the recording modules in the direction of the arrangement of the recording modules. A recording-medium support surface of the sheet storage and/or the sheet receiver may be inclined with respect to the horizontal direction.

The present invention is applicable not only to the serial printer but also to a line printer. The present invention is applicable not only to the ink-jet printing but also to laser printing, thermal transfer printing, and other similar printing. The present invention is applicable not only to the printer but also to other devices such as a facsimile machine and a copying machine.

What is claimed is:

1. A recording apparatus, comprising:

a plurality of recording modules arranged in one direction and each comprising a recording device configured to perform recording on a recording medium comprising a first surface and a second surface which is a back side from the first surface;

a storage configured to accommodate the recording medium;

a receiver configured to receive the recording medium on which recording is performed by any one of the plurality of recording modules;

a first path whose one end is connected to the storage, the first path being defined such that the recording medium is conveyed toward a corresponding one of the plurality of recording modules;

a second path comprising two ends, one of which is connected to the receiver, the second path being defined such that the recording medium is conveyed from a corresponding one of the plurality of recording modules;

a plurality of third paths extending respectively via the plurality of recording modules and defined such that the recording medium to be conveyed in the first path is conveyed toward a corresponding one of the plurality of third paths via a corresponding at least one of a plurality of first connection positions positioned on the first path and corresponding respectively to the plurality of recording modules, the plurality of third paths being defined such that the recording medium to be conveyed in the corresponding one of the plurality of third paths is conveyed toward the second path via a corresponding at least one of a plurality of second connection positions positioned on the second path and corresponding respectively to the plurality of recording modules; and a conveyor configured to convey the recording medium along the first path, the second path, and the plurality of third paths, the two ends of the second path comprising another end located on an opposite side of the plurality of second connection positions from the one end of the second path, said another end being connected to a portion of the first path which is located upstream of the plurality of first connection positions, the conveyor being configured to, when the recording medium having passed through the first path once is conveyed to the first path again via the second path, convey the recording medium in a state in which the first surface and the second surface are reversed when compared with a state in which the recording medium passes through the first path in preceding conveyance;

wherein the conveyor comprises:

a first conveyor configured to convey the recording medium along the first path;

a second conveyor configured to convey the recording medium along the second path; and a plurality of third conveyors configured to convey the recording medium respectively along the plurality of third paths;

wherein the recording apparatus further comprises a controller configured to control the plurality of recording modules, the first conveyor, the second conveyor, and the plurality of third conveyors;

wherein the second conveyor is configured to convey the recording medium in the second path in a first direction directed toward the receiver and a second direction which is opposite the first direction;

wherein the plurality of recording modules comprise:

a first recording module corresponding to a most downstream second connection position on the second path in the first direction among the plurality of second connection positions; and a second recording module different from the first recording module;

wherein the controller is configured to control the second conveyor to switch a conveying direction of the recording medium from the first direction to the second direction when a trailing edge in the first direction, of the recording medium comprising the first surface on which recording has been performed by the second recording module is located on the second path at a position located downstream, in the first direction of a corresponding one of the plurality of second connection positions which corresponds to the second recording module and upstream, in the first direction, of a corresponding one of the plurality of second connection positions which corresponds to the first recording module.

2. The recording apparatus according to claim 1, wherein the second path is defined such that the recording medium to be conveyed by the second conveyor in the second direction is conveyed to the first path via at least one of the plurality of second connection positions and via said another end of the second path.

3. The recording apparatus according to claim 1;

wherein the controller is configured to control the second conveyor to switch the conveying direction of the recording medium from the first direction to the second direction when the trailing edge, in the first direction, of the recording medium comprising the first surface on which recording has been performed by the second recording module is located on the second path at a position located downstream, in the first direction, of the corresponding one of the plurality of second connection positions which corresponds to the second recording module and upstream, in the first direction, of one of the plurality of second connection positions which is adjacent in the first direction to the corresponding one of the plurality of second connection positions.

4. The recording apparatus according to claim 1;

wherein the second conveyor comprises at least one first roller pair disposed between adjacent two of the plurality of second connection positions on the second path, and wherein the controller is configured to control the second conveyor to switch the conveying direction of the recording medium from the first direction to the second direction when the trailing edge, in the first direction, of the recording medium comprising the first surface on which recording has been performed by the second recording module is located on the second path at a position located downstream, in the first direction, of the corresponding one of the plurality of second connection positions which corresponds to the second recording module and upstream, in the first direction, of one first roller pair of the at least one first roller pair which is adjacent in the first direction to the corresponding one of the plurality of second connection positions.

5. The recording apparatus according to claim 4, further comprising;

at least one second sensor configured to output a signal indicating presence or absence of the recording medium at a second sensing position located on the second path at a position located downstream, in the first direction, of the corresponding one of the plurality of second connection positions which corresponds to the second recording module and upstream, in the first direction, of the one first roller pair of the at least one first roller pair which is adjacent in the first direction to the corresponding one of the plurality of second connection positions, wherein the controller is configured to control the second conveyor to switch the conveying direction of the recording medium from the first direction to the second direction, based on a signal output from a signal output from the at least one second sensor.

6. The recording apparatus according to claim 1, further comprising;

a switcher configured to switch a destination of the recording medium conveyed to the first path, to any one of the plurality of third paths, wherein the controller is configured to control the plurality of recording modules, the first conveyor, the second conveyor, the third conveyors, and the switcher such that recording on a first surface and a second surface of one recording medium is performed by a certain one of the plurality of recording modules.

7. The recording apparatus according to claim 1, wherein the controller is configured to execute:

a determination processing in which the controller determines whether there is a recording medium which should be conveyed along the second path in the second direction through a corresponding one of the plurality of second connection positions before a leading edge of the recording medium conveyed along one third path of the plurality of third paths reaches the corresponding one of the plurality of second connection positions which corresponds to a corresponding one of the plurality of recording modules; and a wait processing in which the controller causes the recording medium conveyed by a corresponding one of the plurality of third conveyors to wait in the one third path, when the controller in the determination processing determines that there is a recording medium which should be conveyed through the corresponding one of the plurality of second connection positions which corresponds to the one third path.

8. The recording apparatus according to claim 1;

wherein the receiver is disposed at position at which at least one of the plurality of recording modules is interposed between the receiver and the storage in the one direction.

9. The recording apparatus according to claim 1, further comprising:

a fourth sensor configured to output a signal indicating presence or absence of the recording medium on the first path at a fourth sensing position located upstream of the plurality of first connection positions in the first direction;

wherein said another end of the second path is connected to one of a position on the first path at which the fourth sensing position is located and a position located upstream of the fourth sensing position.

10. The recording apparatus according to claim 1;

wherein another end of the first path is one of the plurality of first connection positions which is located on a most downstream side among the plurality of first connection positions.

11. A recording apparatus, comprising:

a plurality of recording modules arranged in one direction and each comprising a recording device configured to perform recording on a recording medium comprising a first surface and a second surface which is a back side from the first surface;

a storage configured to accommodate the recording medium;

a receiver configured to receive the recording medium on which recording is performed by any one of the plurality of recording modules;

a first path whose one end is connected to the storage the first path being defined such that the recording medium is conveyed toward a corresponding one of the plurality of recording modules;

a second path comprising two ends, one of which is connected to the receiver, the second path being defined such that the recording medium is conveyed from a corresponding one of the plurality of recording modules;

a plurality of third paths extending respectively via the plurality of recording modules and defined such that the recording medium to be conveyed in the first path is conveyed toward a corresponding one of the plurality of third paths via a corresponding at least one of a plurality of first connection positions positioned on the first path and corresponding respectively to the plurality of recording modules, the plurality of third paths being defined such that the recording medium to be conveyed in the corresponding one of the plurality of third paths is conveyed toward the second path via a corresponding at least one of a plurality of second connection positions positioned on the second path and corresponding respectively to the plurality of recording modules; and a conveyor configured to convey the recording medium along the first path, the second path, and the plurality of third paths, the two ends of the second path comprising another end located on an opposite side of the plurality of second connection positions from the one end of the second path, said another end being connected to a portion of the first path which is located upstream of the plurality of first connection positions, the conveyor being configured to when the recording medium having passed through the first path once is conveyed to the first path again via the second path, convey the recording medium in a state in which the first surface and the second surface are reversed when compared with a state in which the recording medium passes through the first path in preceding conveyance;

wherein the conveyor comprises:

a first conveyor configured to convey the recording medium along the first path;

a second conveyor configured to convey the recording medium along the second path; and a plurality of third conveyors configured to convey the recording medium respectively along the plurality of third paths;

wherein the recording apparatus further comprises a controller configured to control the plurality of recording modules, the first conveyor, the second conveyor, and the plurality of third conveyors;

wherein the second conveyor is configured to convey the recording medium in the second path in a first direction directed toward the receiver and a second direction which is opposite the first direction;

wherein the plurality of recording modules comprise:

a first recording module corresponding to a most downstream second connection position on the second path in the first direction among the plurality of second connection positions; and a second recording module different from the first recording module;

wherein the second conveyor comprises a second roller disposed on the second path at a position adjacent in the first direction to a corresponding one of the plurality of second connection positions which corresponds to the first recording module; and wherein the controller is configured to control the second conveyor to switch the conveying direction of the recording medium from the first direction to the second direction when a trailing edge, in the first direction, of the recording medium comprising the first surface on which recording has been performed by the first recording module is located on the second path at a position located downstream, in the first direction, of the corresponding one of the plurality of second connection positions which corresponds to the first recording module and upstream of the second roller pair in the first direction.

12. The recording apparatus according to claim 11, further comprising;

a third sensor configured to output a signal indicating presence or absence of the recording medium at a third sensing position located on the second path at a position located downstream, in the first direction, of the corresponding one of the plurality of second connection positions which corresponds to the first recording module and upstream of the second roller pair in the first direction; and wherein the controller is configured to control the second conveyor to switch the conveying direction of the recording medium from the first direction to the second direction, based on a signal output from the third sensor.

13. A recording apparatus, comprising:

a plurality of recording modules arranged in one direction and each comprising a recording device configured to perform recording on a recording medium comprising a first surface and a second surface which is a back side from the first surface;

a storage configured to accommodate the recording medium;

a receiver configured to receive the recording medium on which recording is performed by any one of the plurality of recording modules;

a first path whose one end is connected to the storage, the first path being defined such that the recording medium is conveyed toward a corresponding one of the plurality of recording modules;

a second path comprising two ends, one of which is connected to the receiver, the second path being defined such that the recording medium is conveyed from a corresponding one of the plurality of recording modules;

a plurality of third paths extending respectively via the plurality of recording modules and defined such that the recording medium to be conveyed in the first path is conveyed toward a corresponding one of the plurality of third paths via a corresponding at least one of a plurality of first connection positions positioned on the first path and corresponding respectively to the plurality of recording modules, the plurality of third paths being defined such that the recording medium to be conveyed in the corresponding one of the plurality of third paths is conveyed toward the second path via a corresponding at least one of a plurality of second connection positions positioned on the second path and corresponding respectively to the plurality of recording modules; and a conveyor configured to convey the recording medium along the first path, the second path, and the plurality of third paths, the two ends of the second path comprising another end located on an opposite side of the plurality of second connection positions from the one end of the second path, said another end being connected to a portion of the first path which is located upstream of the plurality of first connection positions, the conveyor being configured to, when the recording medium having passed through the first path once is conveyed to the first path again via the second path, convey the recording medium in a state in which the first surface and the second surface are reversed when compared with a state in which the recording medium passes through the first path in preceding conveyance;

wherein the conveyor comprises:

a first conveyor configured to convey the recording medium along the first path;

a second conveyor configured to convey the recording medium along the second path; and a plurality of third conveyors configured to convey the recording medium respectively along the plurality of third paths;

wherein the recording apparatus further comprises a controller configured to control the plurality of recording modules, the first conveyor, the second conveyor, and the plurality of third conveyors;

wherein the second conveyor is configured to convey the recording medium in the second path in a first direction directed toward the receiver and a second direction which is opposite the first direction;

wherein the recording apparatus further comprises a plurality of first sensors each configured to output a signal indicating presence or absence of the recording medium at a first sensing position located on a corresponding one of the plurality of third paths; and wherein the controller is configured to control the second conveyor to switch the conveying direction of the recording medium from the first direction to the second direction, based on a signal output from a corresponding one of the plurality of first sensors.

* * * * *